US008533956B2

(12) United States Patent
Perry

(10) Patent No.: US 8,533,956 B2
(45) Date of Patent: Sep. 17, 2013

(54) REBAR INSTALLATION SYSTEM AND METHOD OF SECURING REBAR

(76) Inventor: Jack Perry, Silver Spring, MD (US)

( * ) Notice: Subject to any disclaimer, the term of this patent is extended or adjusted under 35 U.S.C. 154(b) by 959 days.

(21) Appl. No.: 12/625,938

(22) Filed: Nov. 25, 2009

(65) Prior Publication Data

US 2011/0120048 A1 May 26, 2011

(51) Int. Cl.
*B21D 49/00* (2006.01)

(52) U.S. Cl.
USPC ..... 29/897.34; 254/29 R; 140/112

(58) Field of Classification Search
USPC ..... 29/897, 897.3, 897.34, 897.31, 897.312, 29/897.33, 464; 140/112, 92.1; 254/29 R, 254/30
See application file for complete search history.

(56) References Cited

U.S. PATENT DOCUMENTS

| | | | | |
|---|---|---|---|---|
| 1,365,015 | A * | 1/1921 | Zwicker | 140/71 B |
| 2,473,858 | A * | 6/1949 | Butler | 219/56 |
| 4,150,475 | A * | 4/1979 | Bondpers et al. | 29/469 |
| 4,625,773 | A * | 12/1986 | Pfender | 140/112 |
| 5,271,436 | A * | 12/1993 | Pfender et al. | 140/112 |
| 5,305,576 | A | 4/1994 | Giles | |
| 5,665,254 | A * | 9/1997 | Isono et al. | 219/56 |
| 5,672,283 | A * | 9/1997 | Wall | 219/56 |
| 6,000,193 | A | 12/1999 | Valero-Cuevas et al. | |
| 6,223,785 | B1 * | 5/2001 | Barden | 140/112 |
| 6,925,705 | B2 * | 8/2005 | Neckoula | 29/703 |
| 6,944,951 | B2 * | 9/2005 | Barden | 29/897.34 |
| 7,124,785 | B2 * | 10/2006 | Barden | 140/112 |
| 2002/0042981 | A1 * | 4/2002 | Barnum et al. | 29/464 |

* cited by examiner

*Primary Examiner* — Lee D Wilson
*Assistant Examiner* — Jamal Daniel
(74) *Attorney, Agent, or Firm* — Garcia-Zamor IP Law; Ruy M. Garcia-Zamor

(57) ABSTRACT

A rebar installation system that uses rebar drive stations to secure rebar against the inner surface of a coil for securing thereto. The system may increase the ease and speed with which the rebar can be attached while reducing the amount of manpower necessary to complete the project.

17 Claims, 25 Drawing Sheets

40
40
40

REBAR INSTALLATION SYSTEM AND METHOD OF SECURING REBAR

BACKGROUND

The present invention is generally directed to coils for construction and, more specifically, to a rebar installation system for use with coils or reinforcement cages.

Typically, reinforced coils tend to be used during construction to reinforce concrete posts. For example, a hole can be drilled, the reinforced coil placed therein and then concrete poured thereover to provide a reinforced concrete caisson, post, or pier. Conventionally, the iron spirals can be anywhere from 15 to 130 feet (or even longer) and multiple spirals can be inserted into drilled holes (once the straight rebar is attached to reinforce the coil) generally end to end to form much longer lengths. When coils are generally attached end to end there is typically a period of overlap of the spirals of a specified length and also an overlap of a portion of the rebar. That is, the rebar may also extend beyond the end of a spiral to facilitate the rebar being connected to the adjacent spiral. The iron spirals can have a diameter from anywhere from 2 to 14 feet or more.

In the past, reinforced coils have been constructed by rolling a single piece of rebar through bending equipment to produce a spiral of a desired diameter, pitch, and length. Then six or so workers must each support each straight rebar piece while the supported rebar is tied to the spiral using steel tie wire. Those straight rebar pieces that must be held above the lower quarter points (points above four o'clock and eight o'clock) along the inside of the coil can be difficult to hold in place and the work is backbreaking and labor intensive.

It may be advantageous to provide rebar installation system that avoids the need for so many workers, that simplifies the installation of rebar, and which facilitates more efficient securing of rebar in position in the coil for securing thereto.

SUMMARY

Briefly speaking, one embodiment of the present invention is directed to a rebar installation system adapted for locating rebar along an inner surface of a coil. The rebar installation system including a rebar drive station. The rebar drive station including a main mount. A main plate is supported by the main mount and is adapted to support rebar thereon. The main plate generally defining a plane. First and second wing plates are each connected to the rebar drive station and are each configured to pivot about a separate point proximate to the main plate for rotational motion generally through the plane. The first and second wing plates are each adapted to support rebar thereon. First and second lateral rams each extend between the main mount and one of the first and second wing plates. The first and second lateral rams are configured to drive the first and second wing plates generally outwardly from the main mount. A vertical ram is generally located proximate an opposite side of the main mount from the main plate for operation generally within the plane. A wheel is located on an end of the vertical ram distal from the main support and is adapted to support the main mount on rebar. Wherein the rebar drive station is configured to move into the coil with assistance from the wheel. Once the rebar drive station is located within the coil the vertical ram is adapted to extend to cause the rebar supported by the main plate to press against the inner surface of the coil and the first and second lateral rams are adapted to extend to cause the first and second wing plates to rotate generally outwardly so that the rebar supported thereon is pressed against the inner surface of the coil.

In a separate aspect, one embodiment of the present invention is directed to a rebar installation system adapted for locating rebar along an inner surface of a coil. The rebar installation system including a rebar drive station. The rebar drive station including a main mount. A main plate is supported by the main mount and is adapted to support rebar thereon. First and second wing plates are each connected to the rebar drive station and are configured to each pivot about a separate point proximate to the main plate for rotational motion. First and second lateral rams each extend between the main mount and one of the first and second wing plates. The first and second lateral rams are configured to drive the first and second wing plates generally outwardly from the main mount. A vertical ram is generally located proximate an opposite side of the main mount from the main plate for operation generally within the plane. A wheel is located on an end of the vertical ram distal from the main support and is adapted to support the main mount on rebar. Wherein the rebar drive station is configured to move into the coil along a central longitudinal axis thereof with assistance from the wheel. Once the rebar drive station is located within the coil the vertical ram is adapted to extend to cause the rebar supported by the main plate to press against the inner surface of the coil and the first and second lateral rams are adapted to extend to cause the first and second wing plates to rotate generally outwardly so that the rebar supported thereon is pressed against the inner surface of the coil.

In another aspect, the present invention is directed to a rebar installation system adapted for locating rebar along an inner surface of a coil. The rebar installation system including a rebar drive station. The rebar drive station including a main mount. A main plate is supported by the main mount and is adapted to support rebar thereon. The main plate generally defining a plane. First and second wing plates are each connected to the rebar drive station and are each configured to pivot about a separate point proximate to the main plate for rotational motion generally through the plane. The first and second wing plates are each adapted to support rebar thereon. Wherein the rebar drive station is configured to move into the coil with assistance from the wheel. Once the rebar drive station is located within the coil the rebar drive station is adapted to cause the rebar supported by the main plate to press against the inner surface of the coil and the to cause the first and second wing plates to rotate generally outwardly so that the rebar supported thereon is pressed against the inner surface of the coil.

In a separate aspect, the present invention is directed to a rebar drive station including a main mount. A main plate is supported by the main mount and is adapted to support rebar thereon. First and second wing plates are each connected to the rebar drive station and are each configured to pivot proximate to the main plate for rotational motion. The first and second wing plates are each adapted to support rebar thereon. Wherein the rebar drive station is configured to move into the coil with assistance from the wheel. Once the rebar drive station is located within the coil the rebar drive station is adapted to cause the rebar supported by the main plate to press against the inner surface of the coil and to cause the first and second wing plates to rotate generally outwardly so that the rebar supported thereon is pressed against the inner surface of the coil.

In a separate aspect, the present invention is directed to a rebar drive station including a main mount. A main plate is supported by the main mount and is adapted to support rebar thereon. First and second wing plates are each connected to the rebar drive station and are each configured to pivot proximate to the main plate for rotational motion. The first and second wing plates are each adapted to support rebar thereon. Wherein the rebar drive station is configured to move into the coil with assistance from the wheel. Once the rebar drive station is located within the coil the rebar drive station is adapted to cause the rebar supported by the main plate to press against the inner surface of the coil and to cause the first and second wing plates to rotate generally outwardly so that the rebar supported thereon is pressed against the inner surface of the coil. Wherein the outer surface of the main and first and second wing plates is arcuate and are configured such that when the main and first and second wing plates are pressing rebar against the inner surface of the coil there is rebar spaced along the coil generally along the upper half of the coil.

In a separate aspect, the present invention is directed to a method of attaching rebar to an inner surface of a coil. The method includes the steps of: positioning rebar on at least two drive stations; moving at least two rebar drive stations into a coil by moving the at least two drive stations generally along a longitudinal axis thereof; moving a main plate of each rebar drive station toward the inner surface of the coil to secure rebar against an inner surface of the coil; and moving first and second wing plates of each rebar drive station about separate pivot points to secure rebar against an inner surface of the coil, the main and first and second wing plates of each drive station moving through a common plane, wherein the outer surface of the main and first and second wing plates of each rebar drive station are arcuate and are configured such that when the main and first and second wing plates are pressing rebar against the inner surface of the coil there is rebar spaced along the coil generally along a segment of the inner circumference of the coil.

In a separate aspect, the present invention is directed to a rebar installation system adapted for locating rebar along an inner surface of a coil. The rebar installation system including a rebar drive station. The rebar drive station including a main mount. A main plate is supported by the main mount and is adapted to support rebar thereon. The main plate generally defining a plane. First and second wing plates are each connected to the rebar drive station and are each configured to pivot about a separate point proximate to the main plate for rotational motion generally through the plane. The first and second wing plates are each adapted to support rebar thereon. First and second lateral rams each extend between the main mount and one of the first and second wing plates. The first and second lateral rams are configured to drive the first and second wing plates generally outwardly from the main mount. A vertical ram is generally located on the main mount generally within the plane. Wherein once the rebar drive station is located within the coil the vertical ram is adapted to extend to cause the rebar supported by the main plate to press against the inner surface of the coil and the first and second lateral rams are adapted to extend to cause the first and second wing plates to rotate generally outwardly so that the rebar supported thereon is pressed against the inner surface of the coil.

In a separate aspect, the present invention is directed to a rebar installation system adapted for locating rebar along an inner surface of a coil. The rebar installation system including a rebar drive station. The rebar drive station including a main mount. A main plate is supported by the main mount and is adapted to support rebar thereon. First and second wing plates are each connected to the rebar drive station and are each configured to pivot about a separate point proximate to the main plate. The first and second wing plates are each adapted to support rebar thereon. Wherein once the rebar drive station is located within the coil the vertical ram is adapted to press against the inner surface of the coil and the first and second wing plates are configured to press the rebar supported thereon against the inner surface of the coil.

In a separate aspect, the present invention is directed to a rebar installation system adapted for locating rebar along an inner surface of a coil. The rebar installation system including a rebar drive station. The rebar drive station including a main mount. A main plate is supported by the main mount and is adapted to support rebar thereon. First and second wing plates are each connected to the rebar drive station and are each configured to pivot about a separate point proximate to the main plate. The first and second wing plates are each adapted to support rebar thereon. Wherein once the rebar drive station is located within the a single ram is adapted to drive the rebar supported on the main plate against the inside of the coil and to drive the first and second wing plates to press the rebar supported thereon against the inner surface of the coil.

In a separate aspect, the present invention is directed to a rebar installation system adapted for locating rebar along an inner surface of a coil. The rebar installation system including a rebar drive station. The rebar drive station including a main mount. A main plate is supported by the main mount and is adapted to support rebar thereon. First and second wing plates are each connected to the rebar drive station and are each configured to pivot about a separate point proximate to the main plate. The first and second wing plates are each adapted to support rebar thereon. Wherein once the rebar drive station is located within the a single ram is adapted to drive the rebar supported on the main plate against the inside of the coil and to drive the first and second wing plates to press the rebar supported thereon against the inner surface of the coil. The single ram being connected to the first and second lateral wing plates via a drive yolk.

In a separate aspect, the present invention is directed to a rebar installation system adapted for locating rebar along an inner surface of a coil. The rebar installation system including a rebar drive station. The rebar drive station including a main mount. A main plate is supported by the main mount and is adapted to support rebar thereon. First and second wing plates are each connected to the rebar drive station and are each configured to pivot about a separate point proximate to the main plate. The first and second wing plates are each adapted to support rebar thereon. Wherein once the rebar drive station is located within the a single ram is adapted to drive the rebar supported on the main plate against the inside of the coil and to drive the first and second wing plates to press the rebar supported thereon against the inner surface of the coil. The single ram being connected to the first and second lateral wing plates via a bell crank.

In another aspect the present invention is directed to a method of attaching rebar to an inner surface of a coil. The method including the steps of: positioning rebar on at least two drive stations; moving at least two rebar drive stations into a coil by moving the at least two drive stations generally along a longitudinal axis thereof; moving a main plate of each rebar drive station toward the inner surface of the coil to secure rebar against an inner surface of the coil; and moving first and second wing plates of each rebar drive station about separate pivot points to secure rebar against an inner surface of the coil, wherein the moving of the main plate and the moving of the first and second wing plates is driven by a single ram.

BRIEF DESCRIPTION OF THE SEVERAL VIEWS OF THE DRAWINGS

The foregoing summary, as well as the following detailed description of the preferred embodiments of the present invention will be better understood when read in conjunction with the appended drawings. For purposes of illustrating the invention, there are shown in the drawings, embodiments which are presently preferred. It is understood, however, that the invention is not limited to the precise arrangements and instrumentalities shown. In the drawings:

FIG. 22 illustrates the rebar drive station with the single vertical ram positioned so as to fully extend the main and first and second wing plates;

FIG. 26 shows the rebar drive station with the ram piston fully withdrawn to cause the lateral wing plates to be fully extended and the wheel to be fully extended;

DETAILED DESCRIPTION OF THE PREFERRED EMBODIMENT

Figure 1:
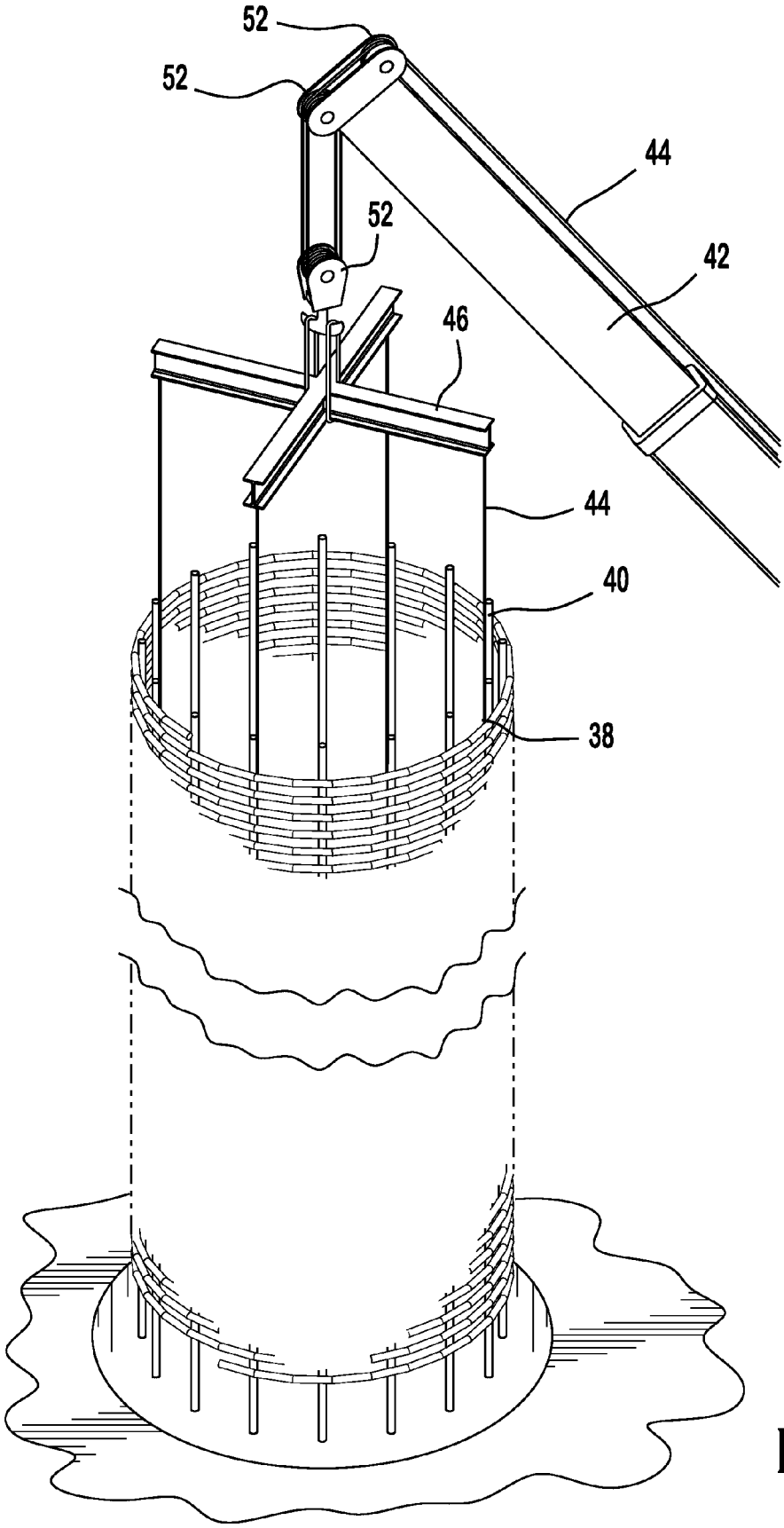
FIG. 1 is a perspective view of coil being positioned within a hole prior to the insertion of concrete; The coil is being hoisted by a crane and includes a generally circular shape with straight rebar pieces reinforcing the coil; The rebar is generally spaced along an inner surface of the coil; The coil can be any one of a coil, a spiral, a spiral coil, a reinforcement cage, a reinforcement structure or the like without departing from the scope of the present invention.

Certain terminology is used in the following description for convenience only and is not limiting. The words "right," "left," "upper," and "lower" designate directions in the drawings to which reference is made. The words "inwardly" and "outwardly" refer to directions toward and away from, respectively, the geometric center of the rebar installation system and designated parts thereof. The term "coil", as used in the claims and the corresponding portions of the specification, means "any one of a coil, a spiral, a spiral coil, a reinforcement cage, a rectilinear reinforcement cage, a reinforcement structure or the like." The term "generally within the same plane" or the like, as used in the claims and in corresponding portions of the specification, is understood to include components that move within planes that are planar parallel and spaced apart by up to six inches. The terminology includes the words above specifically mentioned, derivatives thereof, and words of similar import. Additionally, the words "a" and "one" are defined as including one or more of the referenced item unless specifically stated otherwise.

Referring to FIGS. 1-21, wherein like numerals indicate like elements throughout, preferred embodiments of a rebar installation system are shown and designated as 30. Briefly stated, rebar installation system is adapted to secure rebar in position inside a coil to facilitate securing the rebar in position to form a concrete reinforcement cage (shown supported by a crane 42 in FIG. 1).

The rebar installation system 30, the rebar drive station 36, and their component parts are preferably formed from a half inch plate which may be formed by steel, alloy, or any other suitable material. However, those of ordinary skill in the art will appreciate from this disclosure that the rebar installation system and its various components can be formed from any materials having any suitable thicknesses without departing from the scope of the present invention.

Figure 2:
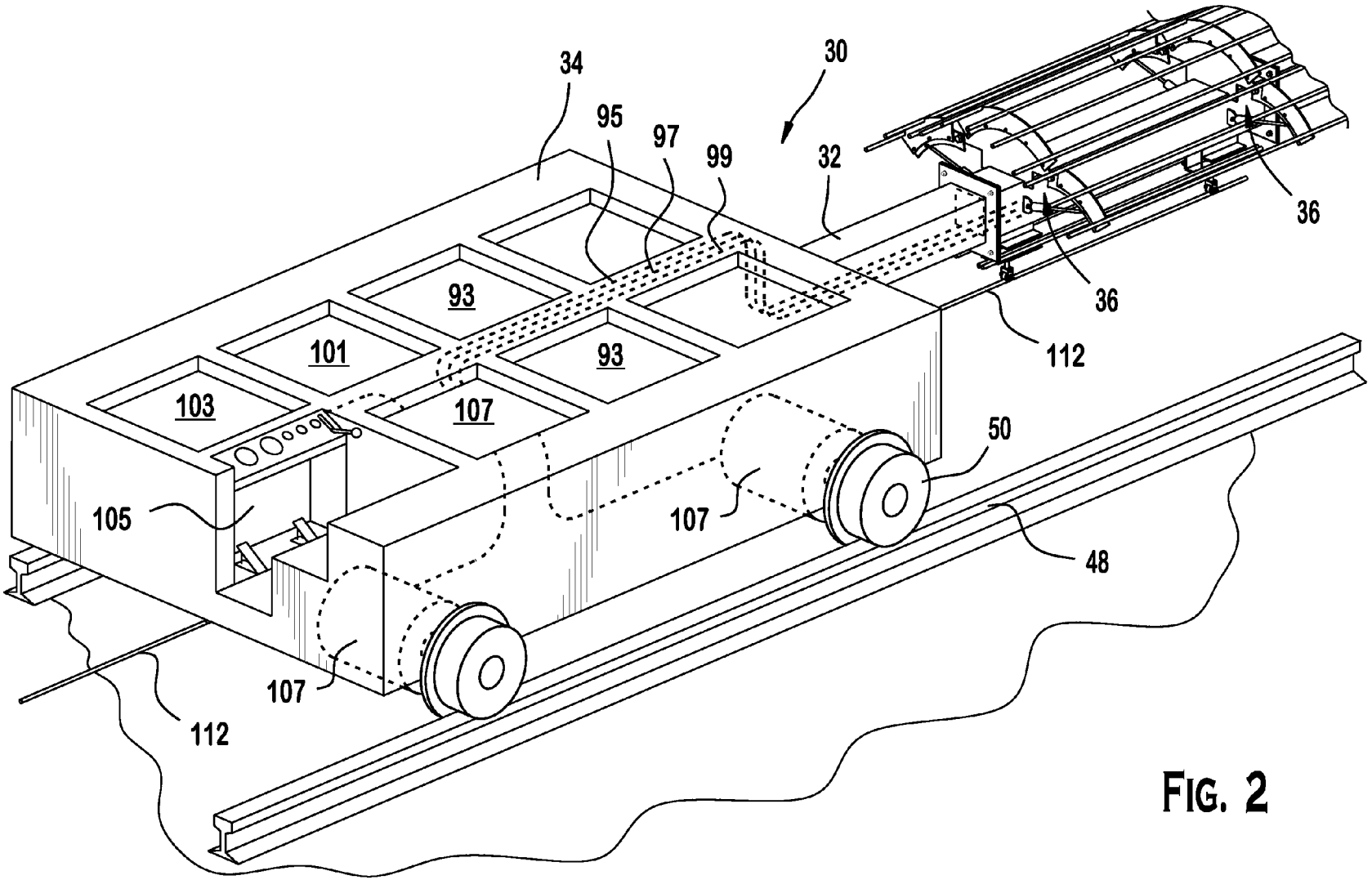
FIG. 2 is a perspective view of a preferred rebar installation system according to the present invention; A carrier vehicle may be used to transport multiple rebar drive stations into a coil along a generally central longitudinal axis of the coil; The vehicle may include a hydraulic fluid reservoir, a hydraulic pump, an engine to drive the hydraulic fluid, and wheels powered by hydraulic or electric motors, controls and an operator's station or the like; Hydraulic hoses and or other control lines may extend from the vehicle through a rod (also referred to as a main mount or support member (which can be a rectangle, square, round or irregular shape when viewed in cross-section)) to the drive station(s); The rebar drive stations can include a main plate and first and second wing plates that can each support rebar.
Figure 3:
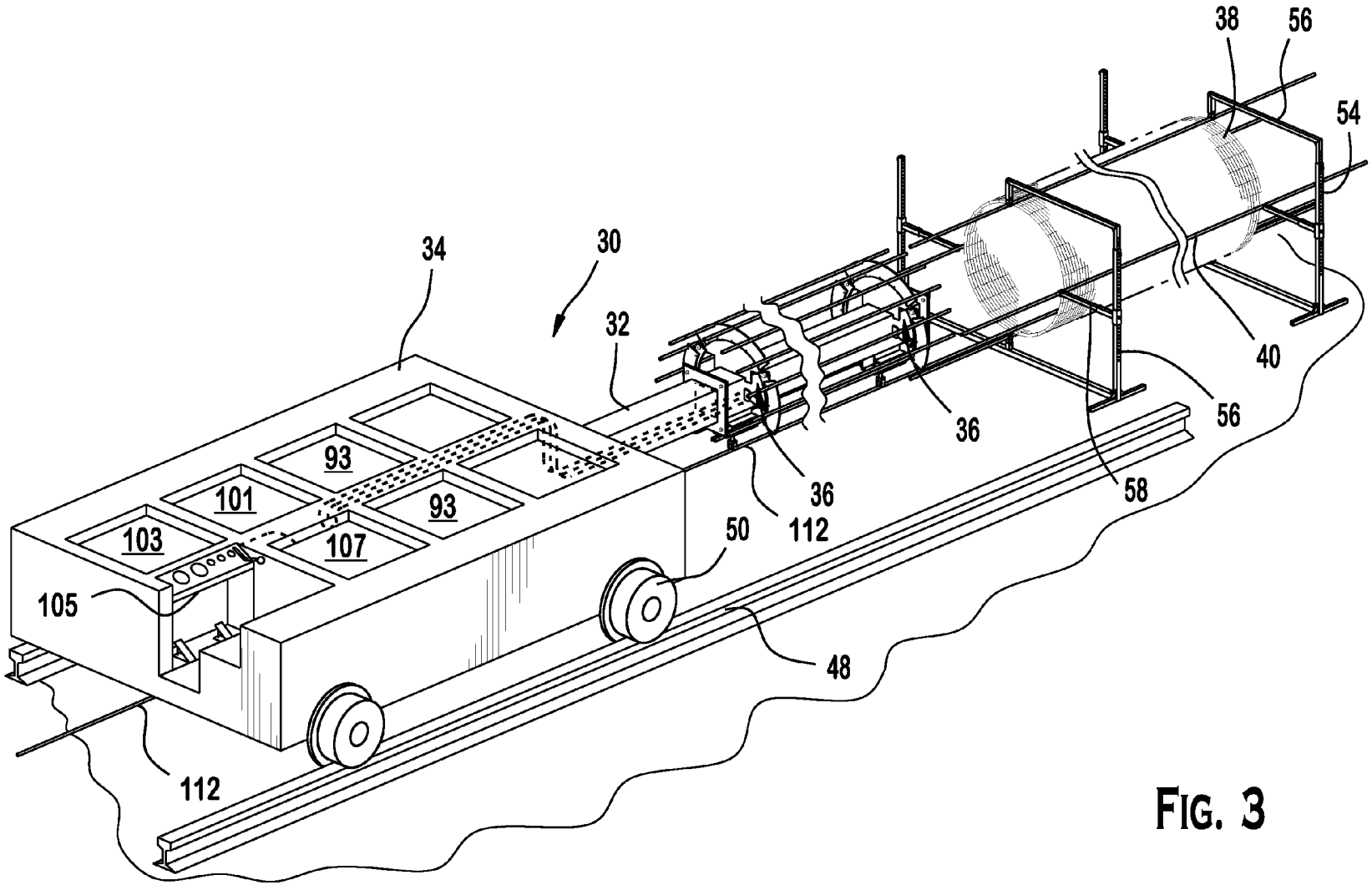
FIG. 3 is a perspective view illustrating the rebar drive stations just prior to insertion into a coil along a longitudinal axis of the coil; The coil may be supported on a spiral jig or the like; The first and second wing and main plates are generally retracted prior to insertion so that the outer diameter of the drive stations (including the supported rebar) is less than the inner diameter of the coil.
Figure 4:
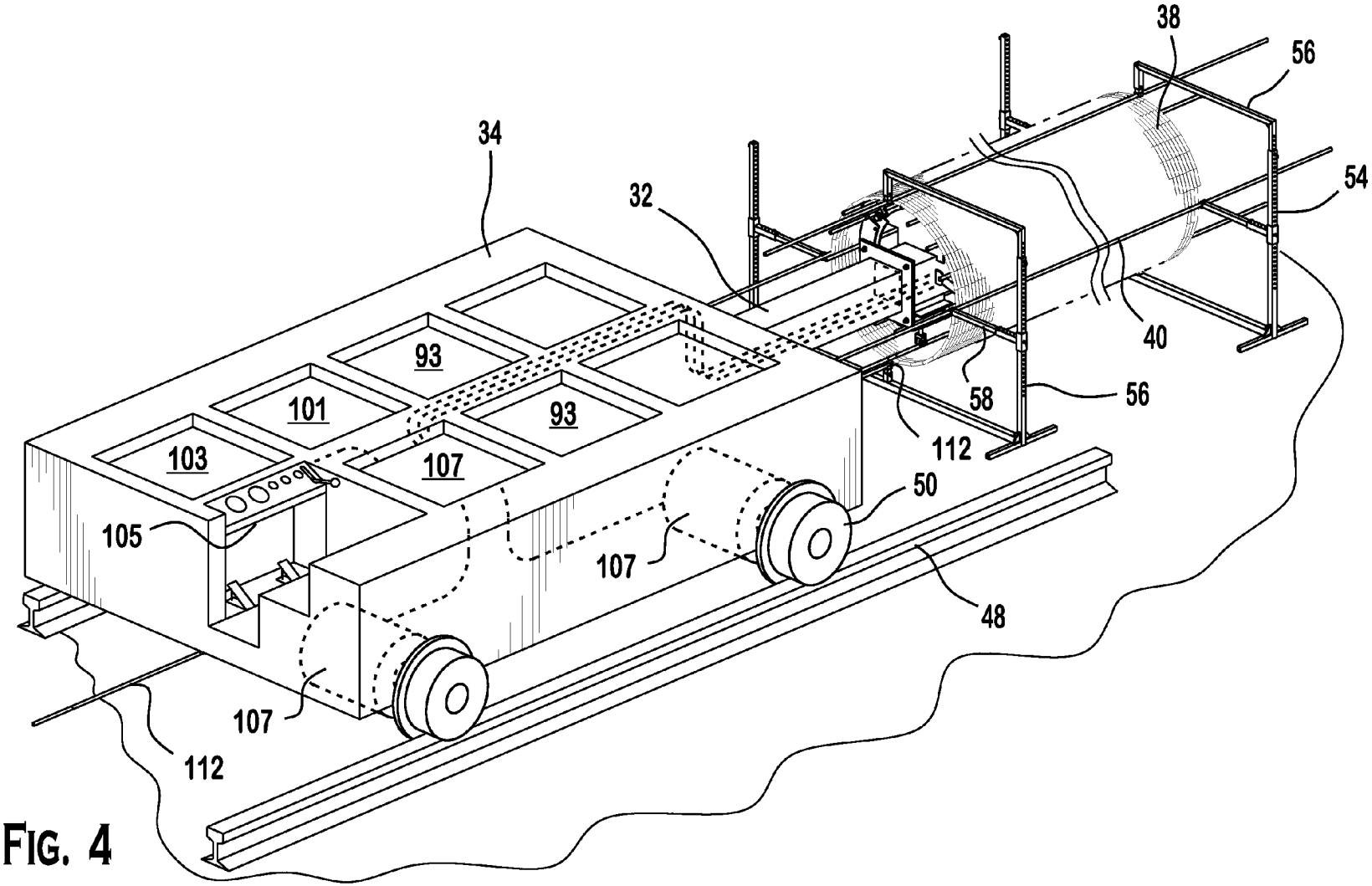
FIG. 4 is a perspective view illustrating the rebar drive stations just after insertion into a coil; Although a preferred carrier vehicle is shown for movement of the rebar drive stations into the coil those of ordinary skill in the art will appreciate from this disclosure that any suitable mechanism or method for movement of the rebar drive stations may be used without departing from the scope of the present invention.
Figure 10:
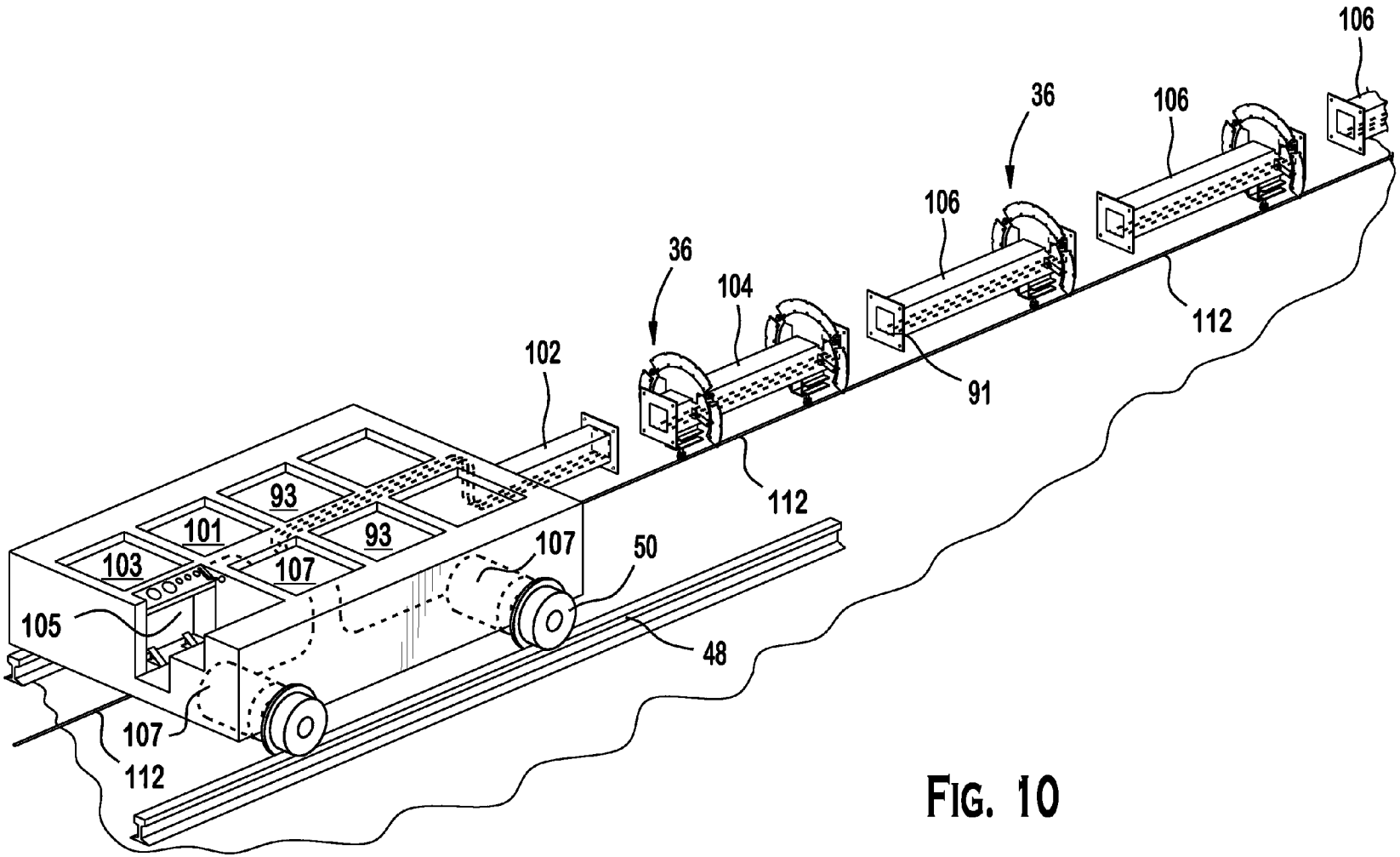
FIG. 10 is an exploded view of the rebar installation system of FIG. 2 showing the vehicle with a main mount and connection plate thereto; The connection plate on the vehicle can be used to attach to a tube section with rebar drive stations located thereon; Additional tube sections can be added as desired to increase the length over which the rebar installation system extends; A main mount (or tube section) can have zero, one, two, or more rebar drive stations located thereon without departing from the scope of the present invention.
Figure 15:
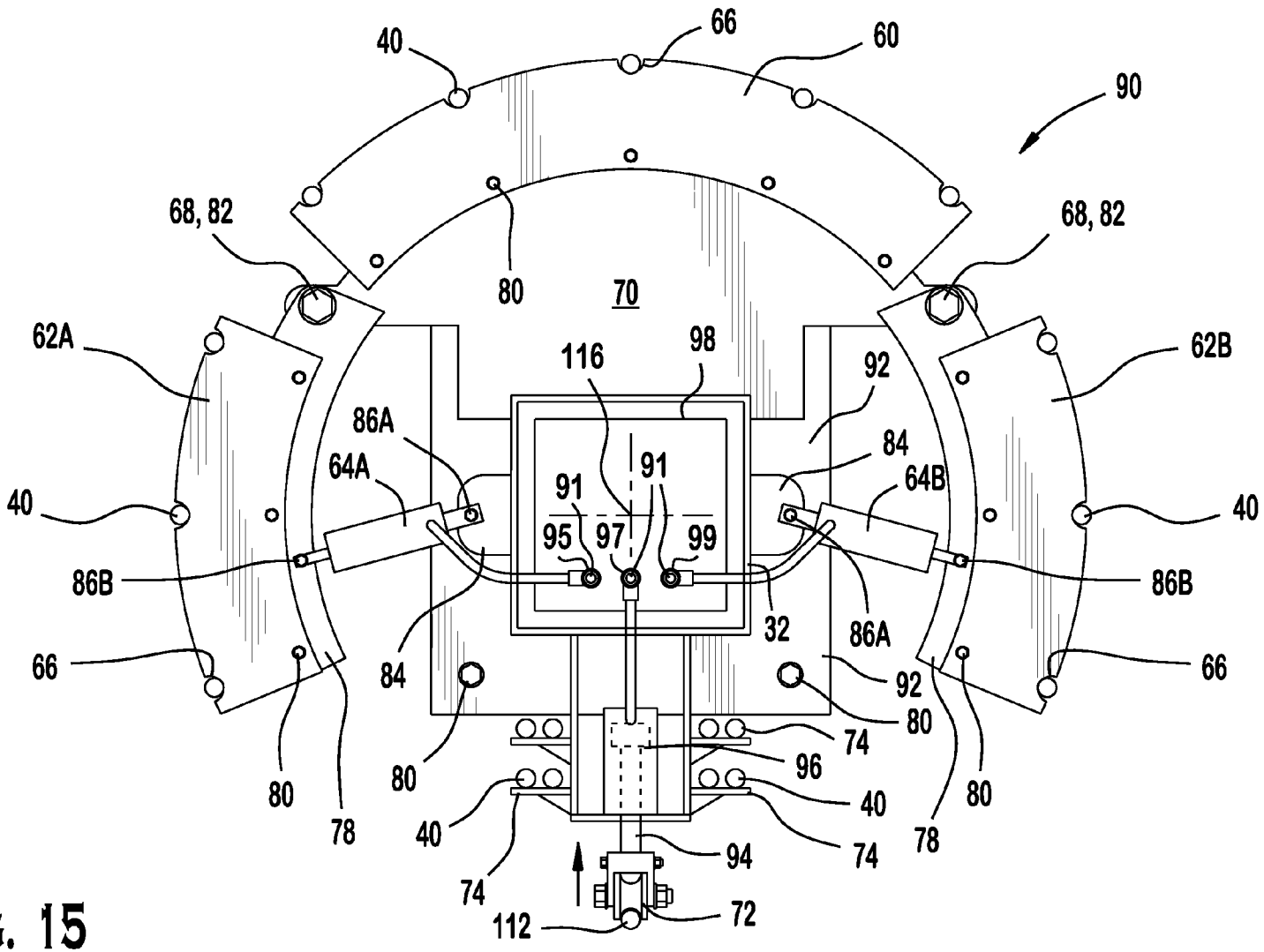
FIG. 15 is a front view of the rebar drive station of FIG. 14 with the first and second wing plates and the main plate retracted; It is preferred that the retraction of the main plate is accomplished by withdrawal of the vertical ram that is located below the main mount; However, those of ordinary skill in the art will appreciate from this disclosure that the main plate may be moveably connected to the main mount via a ram located above the main mount.

Referring to FIGS. 2, 10, and 15, the rebar installation system 30 is adapted for locating rebar 40 along an inner surface of a coil 38. The coil 38 is preferably used to stabilize and reinforce a poured or cast concrete structure. The coil is preferably formed of steel but may be formed of any suitable material. The coil 38 may be formed by a spiral bar or bars or may be formed by discrete circular steel members. Alternatively, the coil 38 may have a non-circular cross sectional shape without departing from the scope of the present invention. If the coil 38 is a spiral it preferably has a pitch of two inches or more and may vary along the caisson.

Figure 7:
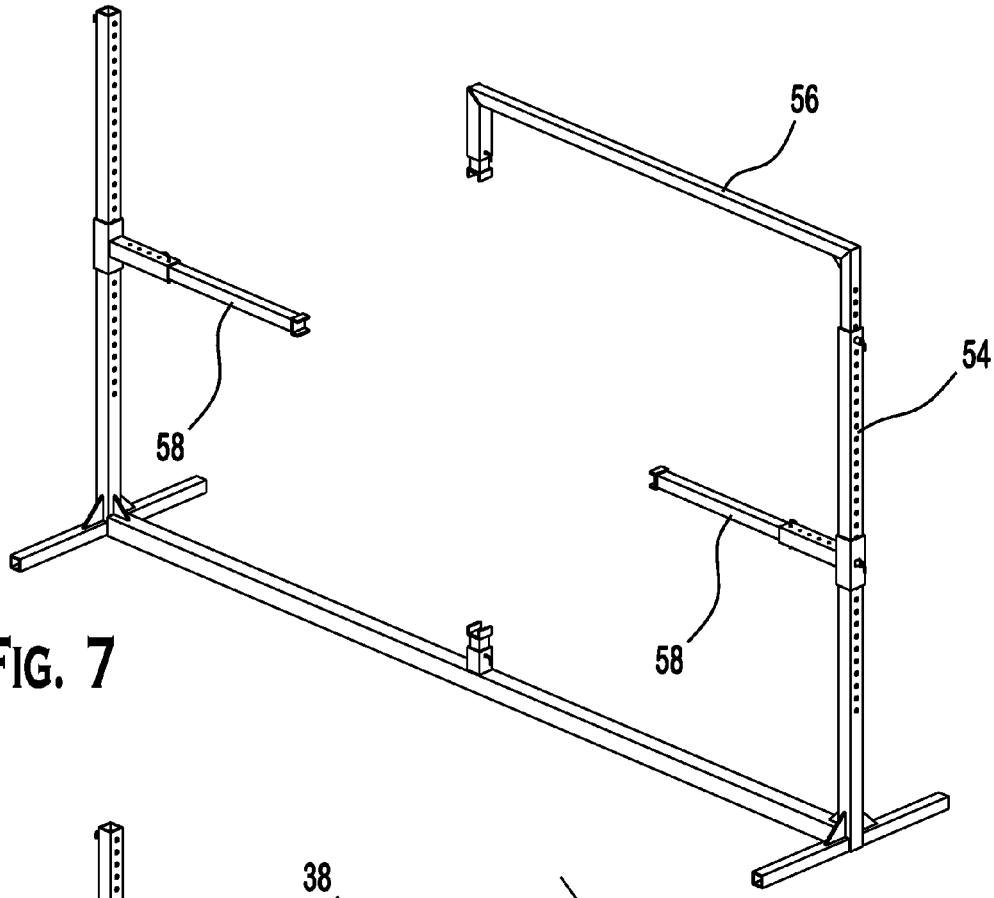
FIG. 7 is a perspective view of a preferred embodiment of a jig used to support the coil; The jig may include tubes, tube segments and holders that face generally inwardly to support a piece of rebar therein; The rebar supported by the holders preferably forms a bearing surface against which the coil can be positioned.
Figure 8:
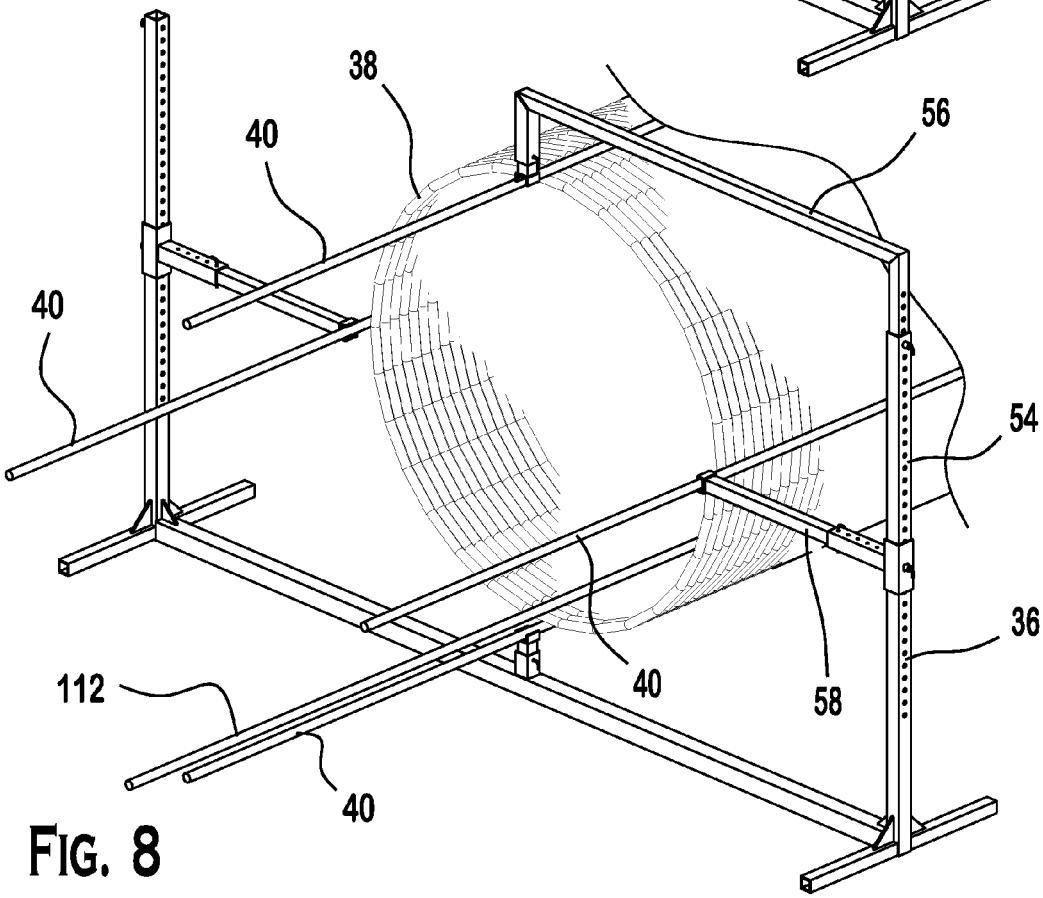
FIG. 8 is a perspective view of the jig of FIG. 7 supporting a coil therein; The exterior of the coil is preferably positioned against straight rebar pieces that are supported by the holders.
Figure 9:
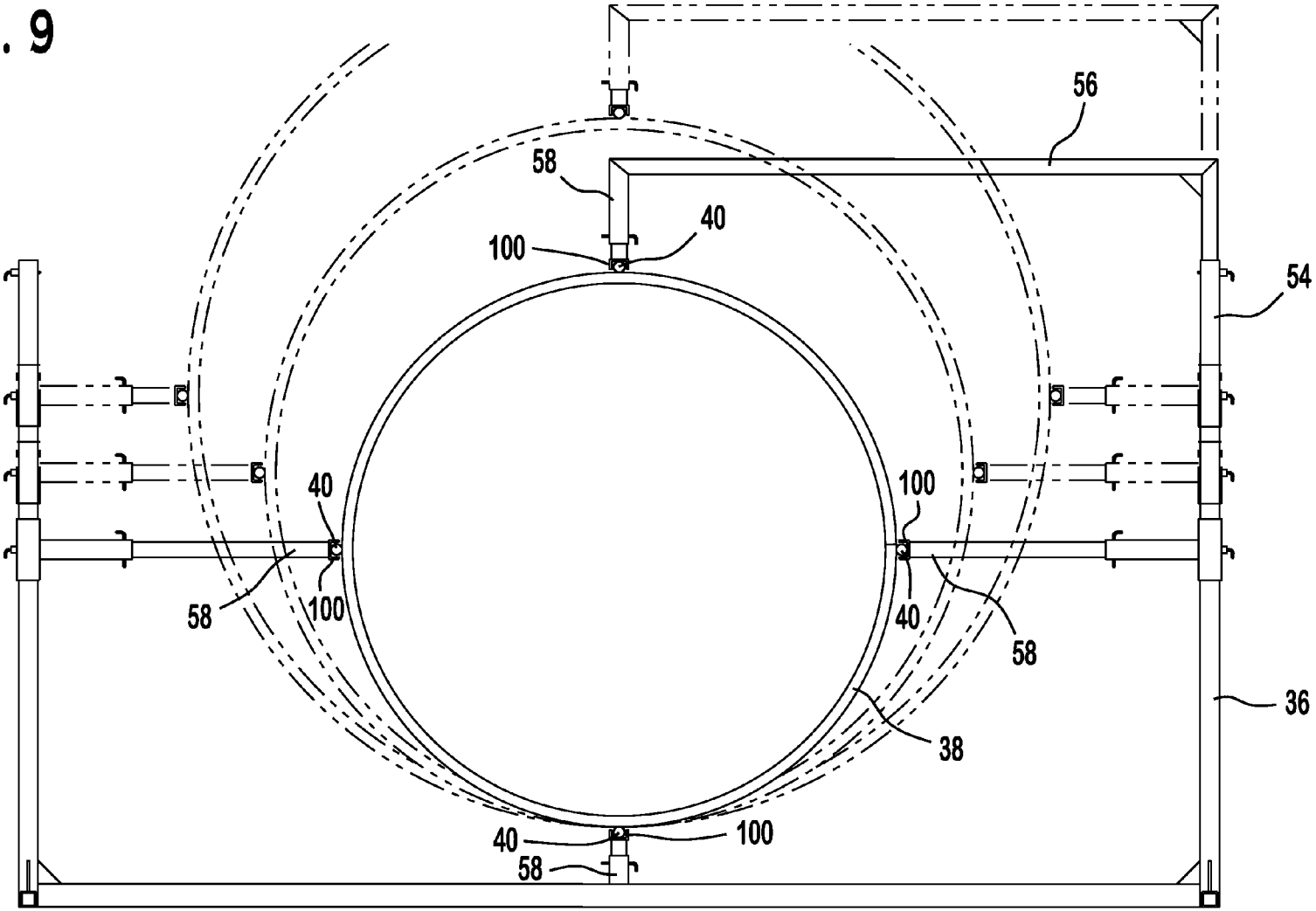
FIG. 9 is a front view of the jig showing illustrating how the jig can be adjusted to support coils of various diameters; A coil of smaller diameter is shown in solid lines and larger diameter coils, as well as the position of parts of the jigs to accommodate such coils, is shown in phantom lines; This can allow the jigs used to support coils to be used with coils of various diameters; Alternatively, the jig may not be adjustable or may only be partially adjustable (such as only allowing the top bar to be detached) without departing from the scope of the present invention.

Referring to FIGS. 7-9, it is preferred, but not necessary, that the coil 38 is supported by a jig 54 while the rebar installation system 30 is inserted along a longitudinal axis 116 (shown in FIG. 5) of the coil 38. The jig preferably includes adjustable tubes 56 and tube segments 58 to accommodate coils 38 of different diameters. The ends of the tube segments 58 that are proximate the coil preferably include holders 100 that support rebar 40 against which the exterior of the coil is positioned. Although one preferred method of supporting the coil is disclosed, those of ordinary skill in the art will appreciate from this disclosure that any suitable method for securing the coil 38 can be used with the rebar installation system without departing from the scope of the present invention.

The rebar installation system 30 is adapted to allow installation of rebar 40 along an inner surface of the coil in a spaced apart, or adjoining, side by side fashion to reinforce the coil 38 as shown in FIG. 1. When the coil is properly reinforced it may be positioned using a crane 42. Referring still to FIG. 1, the crane may use cabling 44, pulleys 52, and a support 46 to maneuver the reinforced coil 38. Those of ordinary skill in the art will appreciate from this disclosure that any suitable mechanism can be used to move the reinforced coil without departing from the scope of the present invention.

The rebar installation system 30 preferably includes a rebar drive station 36. One or more rebar drive stations 36 may be used to position rebar 40 against the coil 38 to allow the rebar 40 to be secured thereto. One method of securing the rebar is to use steel ties. However, welding or any other suitable attachment method can be used without departing from the scope of the present invention.

Figure 11:
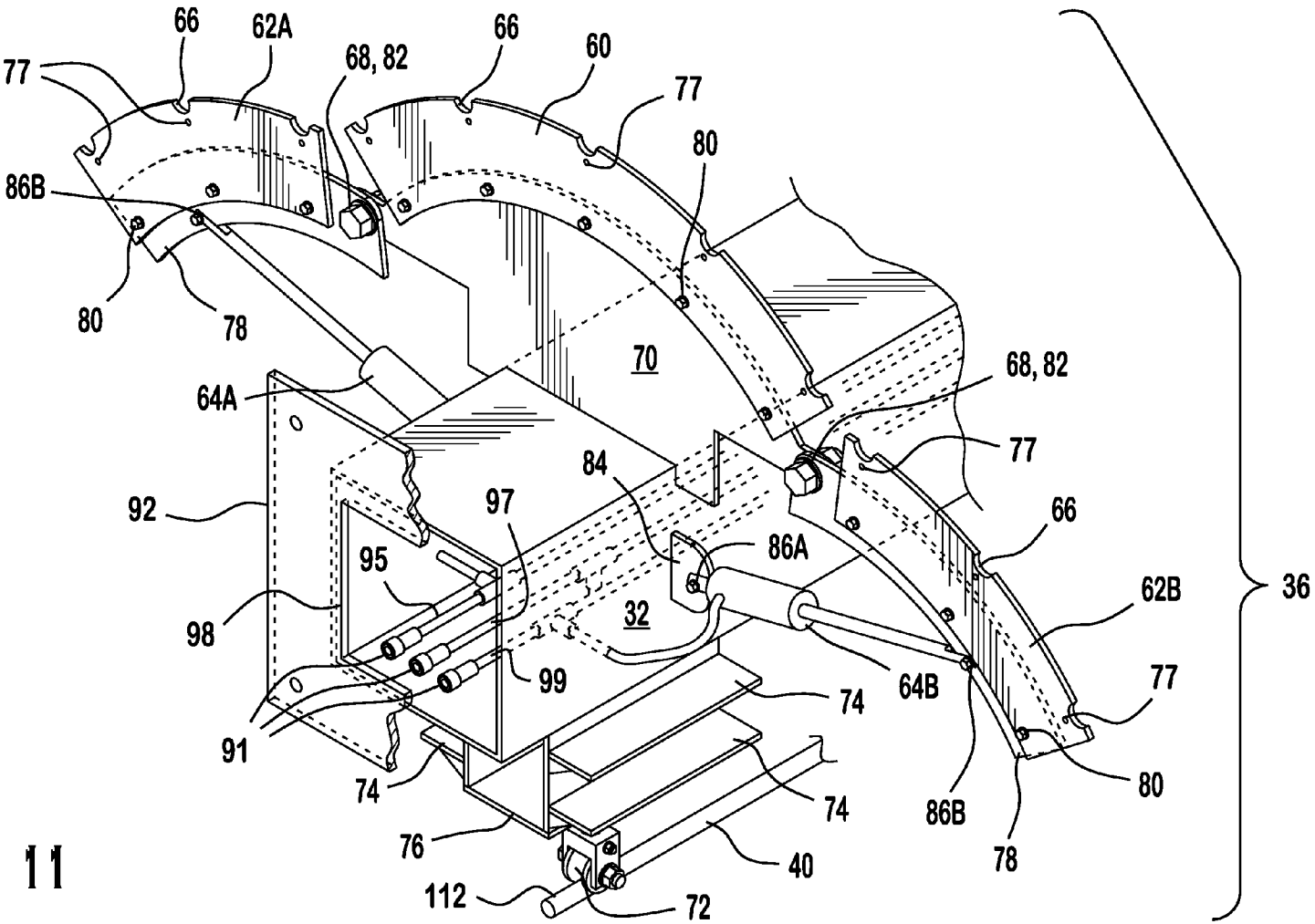
FIG. 11 is a partial perspective view illustrating a preferred rebar drive station; The rebar drive station can include a main mount (or tube section); A main plate may be supported by the main mount and can be adapted to support rebar thereon; The main plate can generally define a plane; First and second wing plates may each be connected to the rebar drive station and each configured to pivot about a separate point proximate to the main plate for rotational motion generally through the plane; The first and second wing plates are preferably each adapted to support rebar thereon; First and second lateral rams can each extend between the main mount and one of the first and second wing plates; The first and second lateral rams may be configured to drive the first and second wing plates generally outwardly from the main mount; A vertical ram can be generally located proximate an opposite side of the main mount from the main plate for operation generally within the plane. A wheel may be located on an end of the vertical ram distal from the main support and to support the main mount on rebar; Hydraulic hose lines may include quick connects to facilitate connection therewith; Holes are shown proximate to cutouts which may be used to allow steel ties to be inserted therethrough and then twisted about a corresponding portion of rebar.

Referring to FIG. 11, the rebar drive station 36 preferably includes a main mount 32. The main mount 36 can, but is not necessarily, formed by a tube section which may have at least one end with a connection plate 92 thereon. While the tube section 32 is illustrated as having a generally square cross-sectional shape and being hollow, those of ordinary skill in the art will appreciate from this disclosure that the tube section may have any shape and may not define a hollow passage without departing from the scope of the present invention. The hollow which is preferably defined by the tube section 32 may allow for hydraulic fluid lines 95, 97, 99 and/or control lines to be located therein (further described below).

Figure 5:
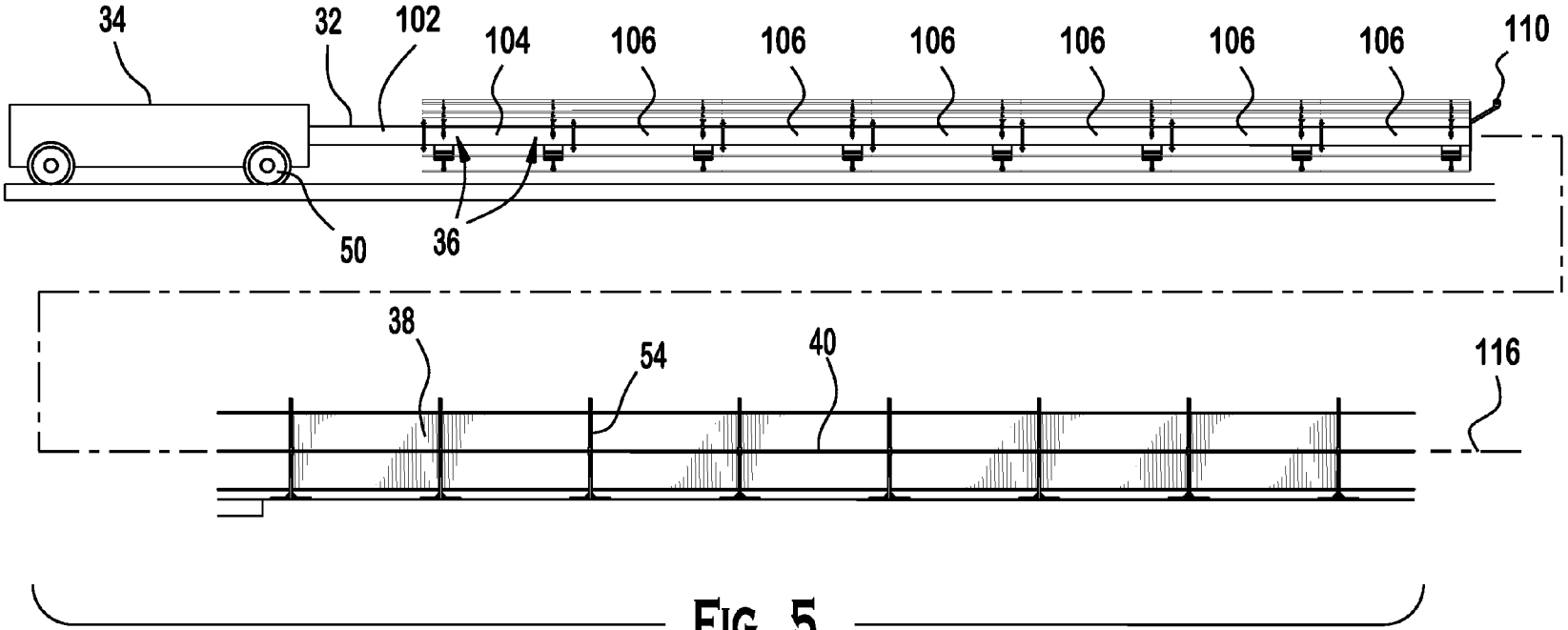
FIG. 5 is side elevational view of the rebar drive system of FIG. 2 illustrating that tube sections (also referred to as main mounts) can be assembled end-to-end to create a rebar installation system in which multiple rebar drive stations cooperate to lift lengths of rebar that can be hundreds of feet in length or more; the dashed assembly line shows the alignment that will be needed between the rebar installation system and the coil to allow insertion; As shown in more detail in FIGS. 11 and 17 it is preferable that the various tube sections are connected by bolting together connection plates and securing any fluid or control lines via quick connects; The preferred sectional nature of the rebar installation system allows the system to be used with coils of any length.
Figure 6:
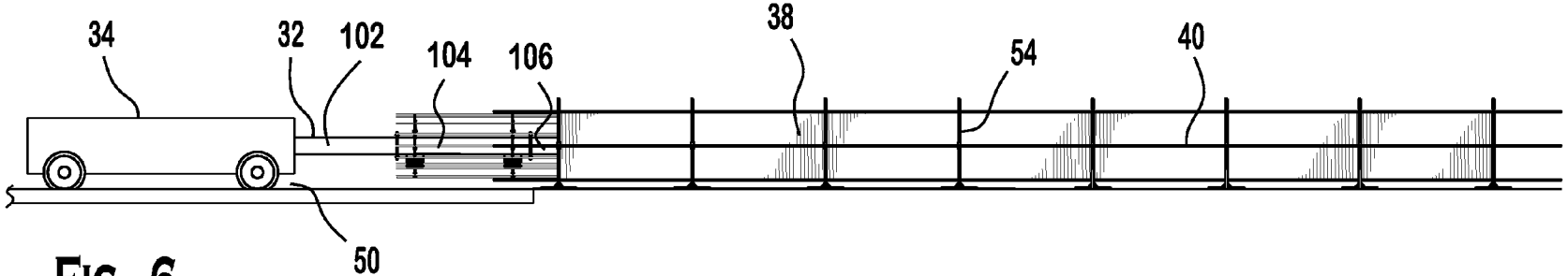
FIG. 6 is a side elevational view of the rebar installation system of FIG. 2 showing the drive stations mostly inserted into the coil; Coil supporting jigs or any other stabilizing structure may be spaced at any desired interval to allow the coil to be held securely in position during the rebar installation process.

The main mount 36 is preferably adapted to engage another tube section 104, 106. The other tube section preferably has at least one rebar drive station 36. As shown in FIGS. 5 and 10, the can allow the rebar installation system 30 to be adjusted in length depending on the coil 38 in which rebar 40 is being installed.

Figure 13:
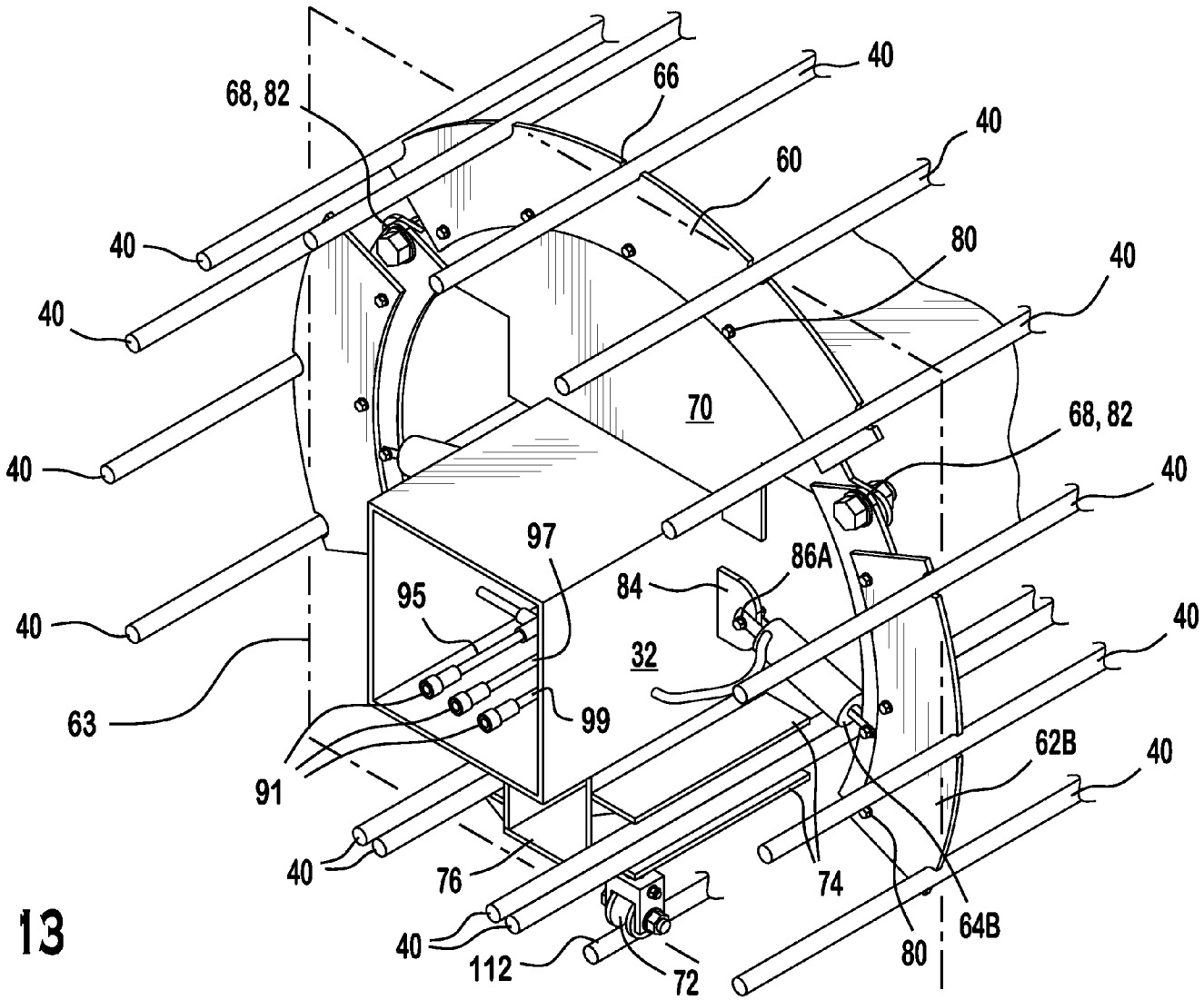
FIG. 13 is a partial perspective view illustrating a rebar drive station with the first and second wing plates and the main plate retracted and supporting rebar thereon; Dashed lines also illustrate how the first and second wing plates, the main plate, and the wheel are all preferably configured for movement within a common plane; those of ordinary skill in the art will appreciate from this disclosure that the first and second wing plates, the main plate, and the wheel can all be offset so that they don't operate in the same plane without departing from the scope of the present invention.
Figure 14:
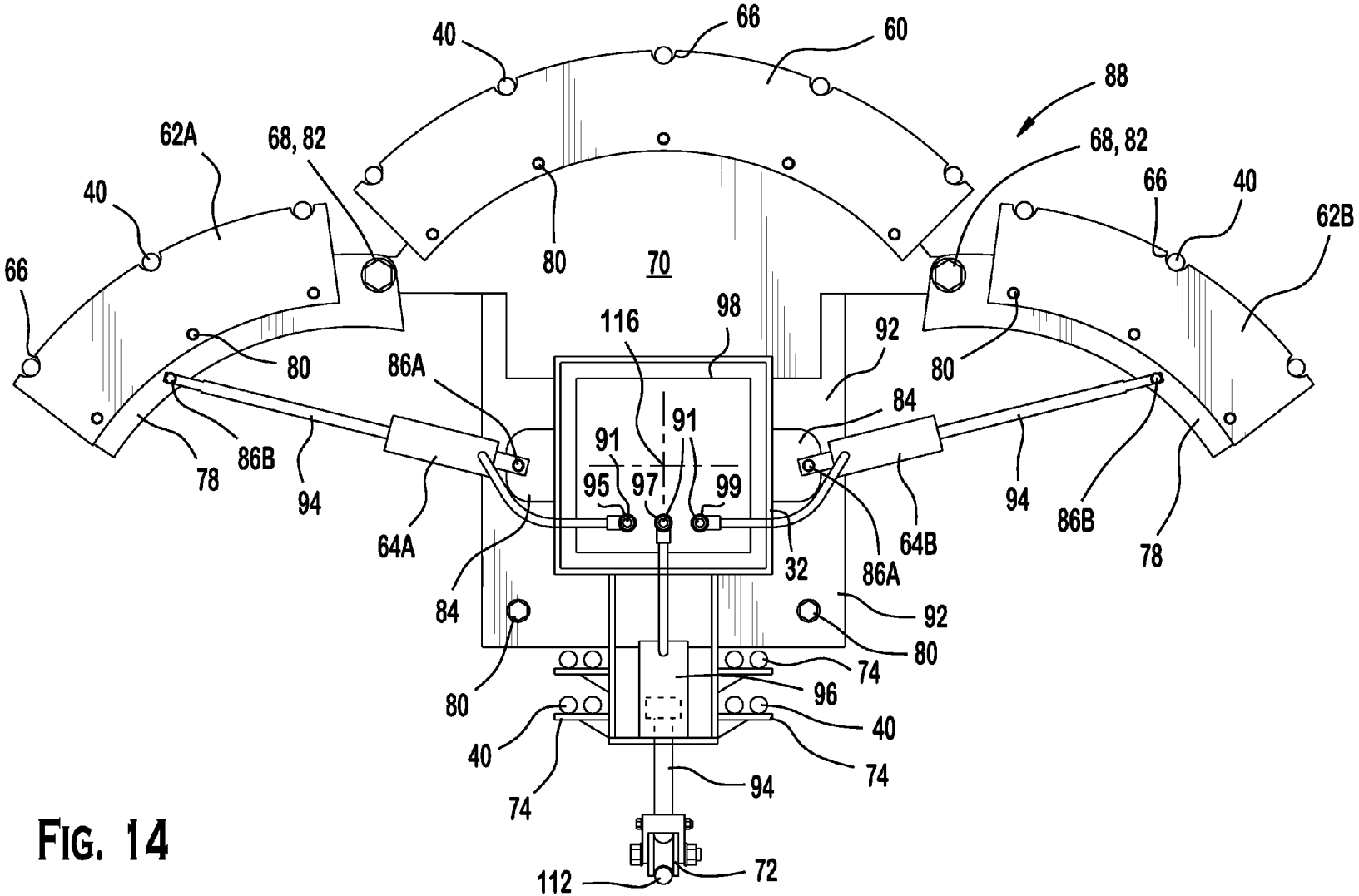
FIG. 14 is a front view of the rebar drive station of FIG. 13 illustrating the first and second wing plates and the main plate extended; It is preferred, but not necessary that the position of the main plate is adjusted by operation of the vertical ram located under the main mount; As such, the main plate is considered to be extended when the vertical ram lifts the main mount on which the main plate is supported.
Figure 16:
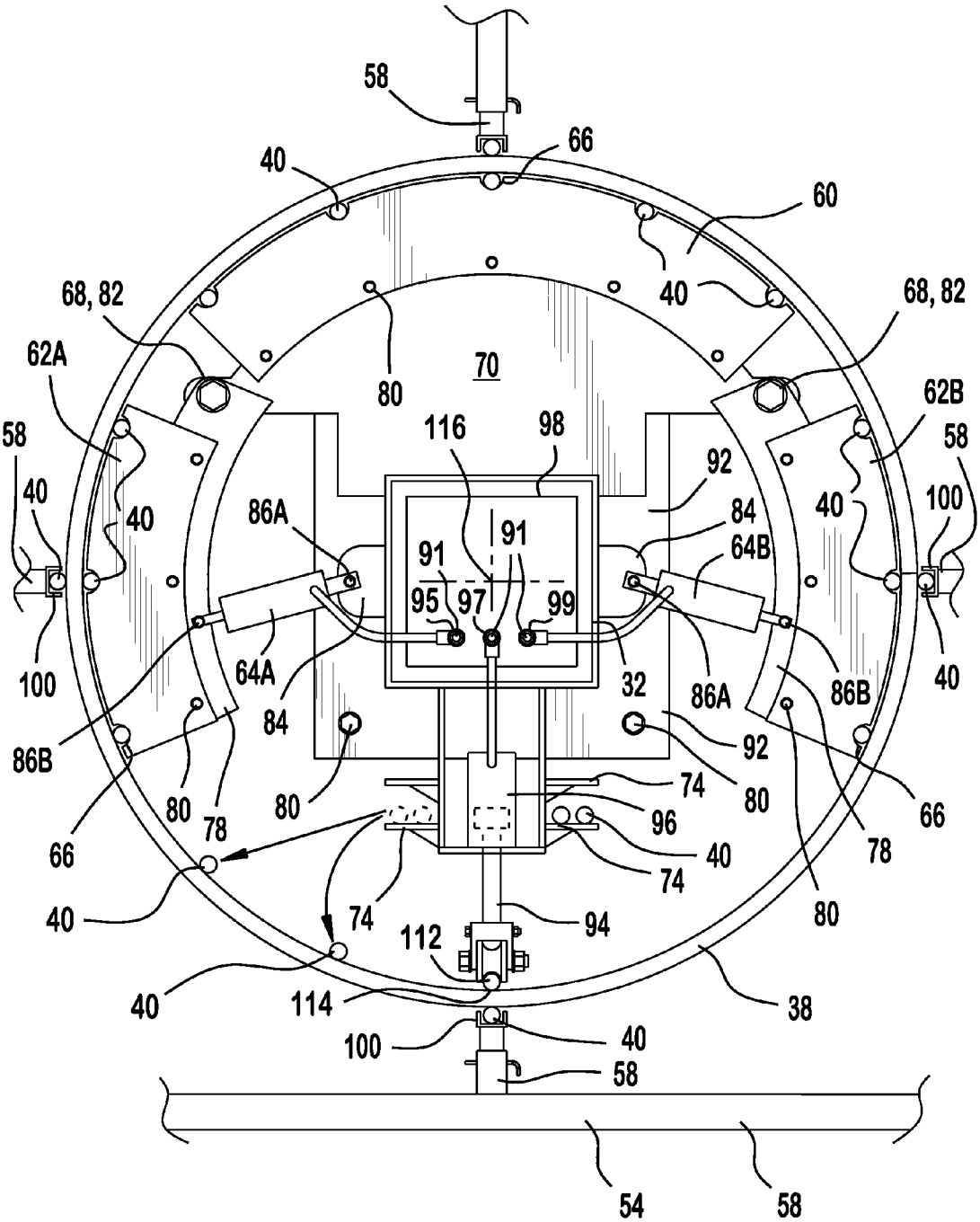
FIG. 16 is a front view of the rebar drive station of FIG. 14 with the first and second wing plates and the main plate extended to press the supported rebar against the inner surface of the coil; While in this example the plates are not fully extended they are extended to the proper distance for pressing rebar against the inside of coil of the size shown; Arrows also show the movement of rebar from the temporary rebar supports to the lower half of the coil; The temporary rebar supports allow the rebar to be manually positioned in a ready fashion; The temporary rebar supports can in some embodiments support enough rebar for the entire reinforcement operation and the amount of rebar supported thereon can be greatly larger than that shown without departing from the scope of the present invention.

Referring to FIGS. 13, 14, and 16, it is preferred, but not necessary that the main mount comprises a tube section 32 and a housing 76 located thereon which is adapted to secure a vertical ram 96 to the rebar drive station 36. The vertical ram 96 is preferably located below the tube section 32 and is partially enclosed by the housing 76 such that the ram piston 94 extends therefrom. The vertical ram 96 (as well as the first and second lateral rams 64A, 64B which are further described below) are preferably formed by hydraulic rams having pistons 94. Alternatively, the vertical ram 96 can be housed in the tube section or otherwise positioned in any suitable fashion without departing from the scope of the present invention. If the vertical ram 96 is located within the tube section 32, then any control lines could pass along a side of the vertical ram 96 or the outside of the tube 32. However, those of ordinary skill in the art will appreciate from this disclosure that any suitable drive mechanism, solenoid, gear arrangement, electrical motor, or gearing can be used to drive the rams 64A, 64B, 96 without departing from the scope of the present invention.

Referring to FIG. 16, flanges 74 may extend laterally outwardly from the rebar drive station. The flanges 74 may form rebar supports for temporarily holding rebar 40 during insertion of the rebar installation system 30 into a coil 38. The flanges 74 are preferably adapted to support rebar 40 thereon to facilitate transport and manual removal thereof. Once the rebar installation system 30 is inserted into the coil 38, rebar 40 located on the flanges 74 can be manually removed and positioned along the inner surface of the coil 38 generally, but not necessarily, at locations below the midway height or the bottom one third of the height of the coil 38 and manually held for securing to the coil. Manual placement of rebar 40 at lower points on the coil 38 is easier since the rebar 40 does not have to be lifted by a substantial amount and in most cases is moved downwardly from the flanges 74. Dashed circles on the left rebar support 74 show the position in which rebar 40 held during insertion of the rebar installation system 30 into the coil. Arrows extending from the dashed circles show the path through which the rebar 40 was moved for placement along an inner surface of the coil 38. While it is preferred that two rebar supports 74 extend from either side of the housing 76 of the tube section 32, those of ordinary skill in the art will appreciate from this disclosure that any number of rebar supports 74 can be used or omitted altogether without departing from the scope of the present invention.

Figure 12:
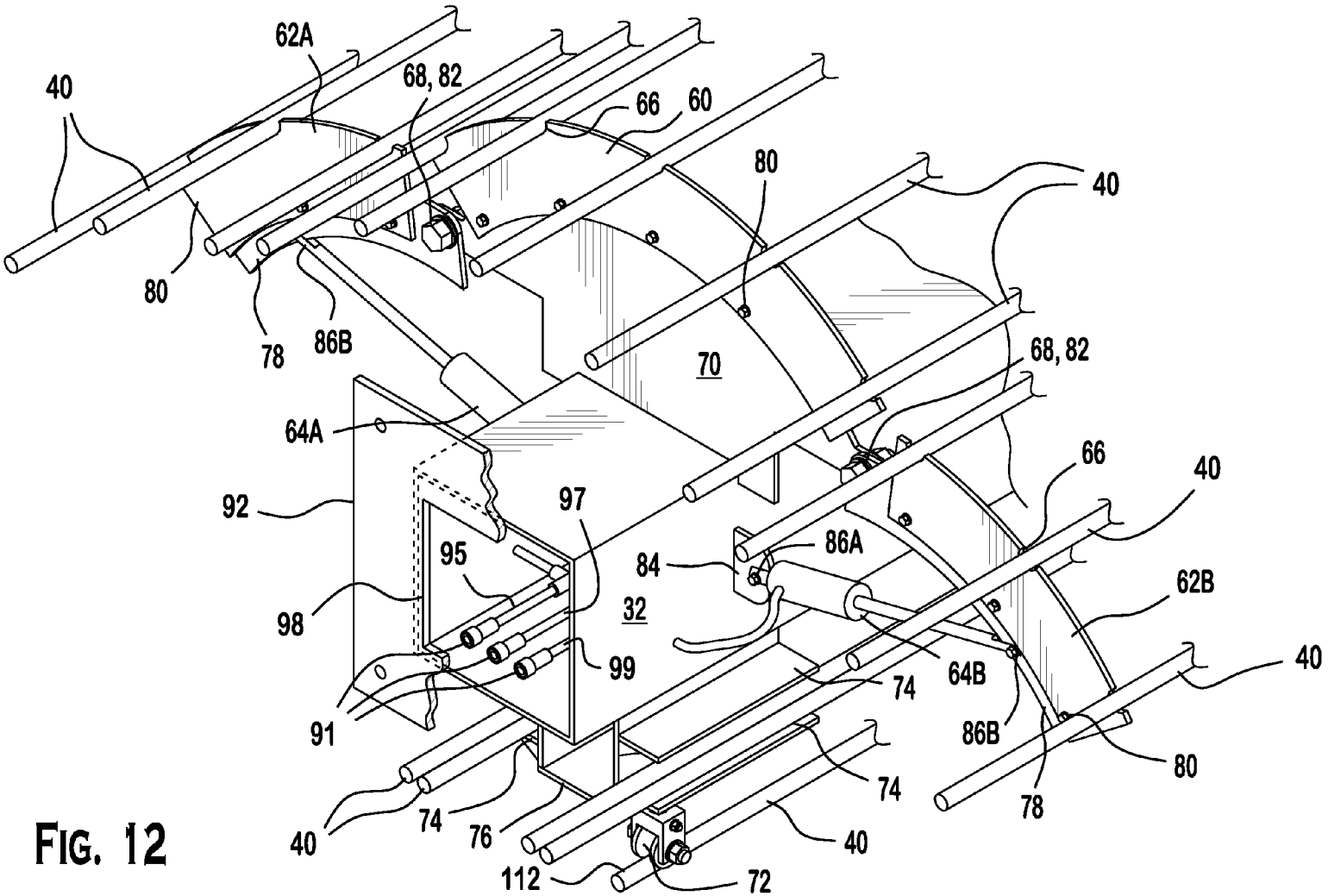
FIG. 12 is a partial perspective view illustrating a rebar drive station with the first and second wing plates and the main plate extended and supporting rebar thereon; Rebar is also supported on temporary rebar supports located under the main mount; Although the first and second wing plates and the main plate are shown fully extended, in use the first and second wing plates and the main plate may only be partially extended due to the size of the inner diameter of the coil; The use of the first and second wing plates and the main plate in the fully extended position correspond to the use of the rebar drive station with a coil that has the maximum interior diameter with which the rebar installation system is configured to operate.

Referring to FIG. 12, a main plate 60 is preferably supported by the main mount 32 and is adapted to support rebar thereon 40. The main plate 60 may have a generally arcuate upper surface and can include notches or cutouts 66 therein for supporting rebar 40. While the main plate 60 is shown as supporting five generally evenly spaced pieces of rebar 40, those of ordinary skill in the art will appreciate from this disclosure that the main plate can be configured to hold any number of rebar and may use irregular spacing without departing from the scope of the present invention.

Referring to FIG. 13, it is preferably, but not necessary, that the main plate 60 generally defining a plane 63 (which is shown in phantom lines). The main mount 32 may include a support plate 70 thereon on which the main plate 60 is positioned. It is preferred that the main plate 60 is connected to the support plate 70 via bolts 80. However, those of ordinary skill in the art will appreciate from this disclosure that the main plate 60 and the support plate 70 can be connected using any suitable method or may be formed as a single piece without departing from the scope of the present invention.

Figure 17:
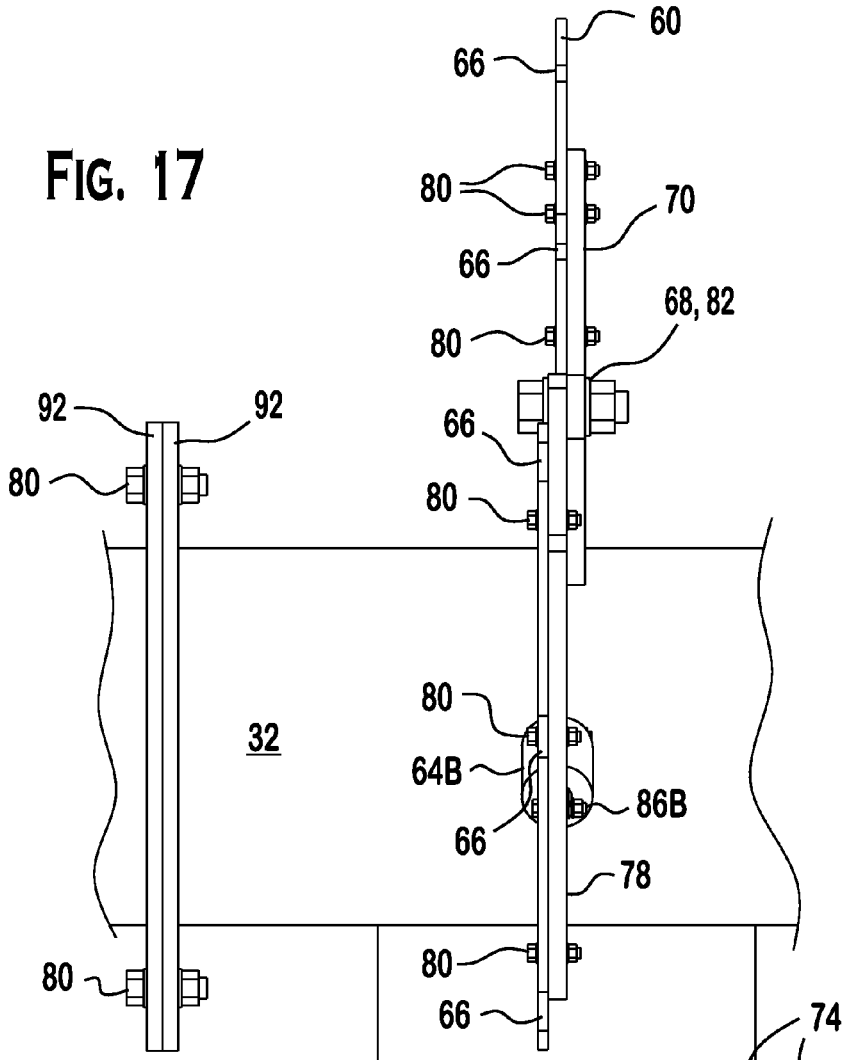
FIG. 17 is a broken away view showing two tube sections secured together using the connection plates; The figure also illustrates that the main and lateral wing plates and wheel may all generally operate within a common plane (also shown in FIG. 13); The main mount may be formed by a tube section that includes a housing located thereunder that encloses at least part of the vertical ram; The main mount can also be formed out of a modified I-beam or any other suitable structure without departing from the scope of the present invention.

Referring to FIGS. 14 and 17, it is preferred that first and second wing plates 62A, 62B are each connected to the rebar drive station 36 and each configured to pivot about a separate point 68 proximate to the main plate 60 for rotational motion generally through the plane 63. It is more preferred, but not necessary, that the first and second wing plates 62A, 62B are pivotally connected to the main plate 60 by pin 82 at pivot point 68.

The first and second wing plates 62A, 62B are each adapted to support rebar thereon. While first and second wing plates 62A, 62B are each shown as supporting three generally evenly spaced pieces of rebar 40, those of ordinary skill in the art will appreciate from this disclosure that the first and second wing plates 62A, 62B can be configured to hold any number of rebar 40 and may use irregular spacing without departing from the scope of the present invention. While the preferred rebar drive stations 36 are shown with three rebar supporting plates 60, 62A, 62B, those of ordinary skill in the art will appreciate from this disclosure that additional sets of two wing plates may be added to increase the size of coil with which the rebar installation system can operate. That is secondary wing plates can each be added to the ends of the first and second wing plates 62A, 62B to allow the rebar installation system 30 to be modified on site to operate with even larger diameter coils 38 or to increase the segment of the coil along which rebar is positioned without departing from the scope of the present invention.

It is preferred that the outer surface of the main plate 60 and first and second wing plates 62A, 62B is arcuate and is configured such that when the main plate 60 and first and second wing plates 62A, 62B are pressing rebar 40 against the inner surface of the coil 38 (as shown in FIG. 16) there is rebar spaced along the coil generally along the upper half of the coil 38. It is more preferred that the main plate 60 and first and second wing plates 62A, 62B are configured such that when the main plate 60 and first and second wing plates 62A, 62B are pressing rebar 40 against the inner surface of the coil 38 there is rebar 40 spaced along the coil 38 generally along approximately fifty percent of the inner circumference of the coil 38. It is further preferred that the main plate 60 and first and second wing plates 62A, 62B are configured such that when the main plate 60 and first and second wing plates 62A, 62B are pressing rebar 40 against the inner surface of the coil 38 there is rebar 40 spaced along the coil 38 generally along approximately fifty five percent of the inner circumference of the coil 38. It is more preferred still that the main plate 60 and first and second wing plates 62A, 62B are configured such that when the main plate 60 and first and second wing plates 62A, 62B are pressing rebar 40 against the inner surface of the coil 38 there is rebar 40 spaced along the coil 38 generally along approximately sixty percent of the inner circumference of the coil 38.

It is preferred, but not necessary, that flanges 74 extend generally laterally outwardly from the rebar drive station 36 and are adapted to support rebar 40 thereon to facilitate transport and manual removal thereof. Each of the first and second wing plates 62A, 62B may include a lateral support plate 78.

Referring to FIG. 14, first and second lateral rams 64A, 64B can each extend between the main mount 32 and one of the first and second wing plates 62A, 62B. The first and second lateral rams 64A, 64B can each configured to drive the first and second wing plates 62A, 62B generally outwardly from the main mount 32. It is preferred that the first and second lateral rams 64A, 64B and the vertical ram 96 are formed by hydraulic pistons. Control lines 95, 97, 99 for the hydraulic pistons may extend at least partially through the tube section 32. The rams can be formed by any suitable solenoid, gearing arrangement or gearing without departing from the scope of the present invention.

It is preferred, but not necessary that the position of the main plate 60 is adjusted by operation of the vertical ram 96 located under the main mount 32. As such, the main plate 60 may be considered to be extended when the vertical ram 96 lifts the main mount 32 on which the main plate 60 is supported. A vertical ram may be generally located proximate an opposite side of the main mount 32 from the main plate for operation generally within the plane 63.

Figure 18:
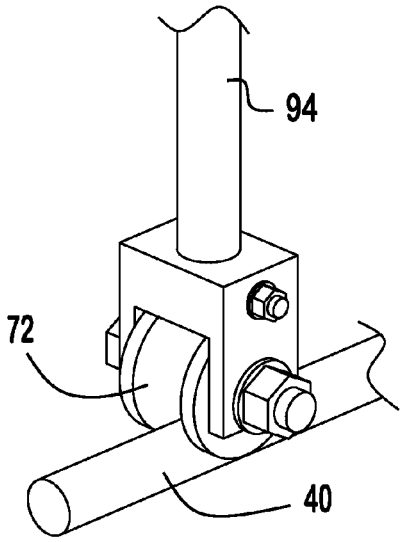
FIG. 18 is an enlarged broken away perspective view showing the wheel of a rebar drive station positioned on a straight section of rebar; To move the rebar drive stations into the coil it is preferred that a piece of generally straight guide rebar is positioned at the lowest central point on the inner surface of the coil; Wheels for each of the rebar drive stations may be positioned on the guide rebar such that the wheels provide vertical support for the rebar drive stations and associated tube sections during insertion into the coil.

Referring to FIGS. 17 and 18, a wheel 72 may be located on an end of the vertical ram 96 distal from the main support 32 and may be adapted to support the main mount 32 on rebar 40. It is preferred, but not necessary, that the rebar drive station 36 is configured to move into the coil 38 with assistance from the wheel 72. Once the rebar drive station 36 is located within the coil 38 the vertical ram 96 may be adapted to extend to cause the rebar 70 supported by the main plate 60 to press against the inner surface of the coil 38 and the first and second lateral rams 64A, 64B can be adapted to extend to cause the first and second wing plates 62A, 62B to rotate generally outwardly so that the rebar 40 supported thereon is pressed against the inner surface of the coil 38. Those of ordinary skill in the art will appreciate from this disclosure that the wheel 72 can be omitted without departing from the scope of the present invention.

Referring to FIGS. 2-6, a carrier vehicle 34 may support another connection plate 92 that is adapted to secure at least one main mount 32 thereto. The at least one main mount 32 preferably including the rebar drive station 36. The carrier vehicle 34 may include a reservoir 93, pump 101, and pump engine 103 for supplying fluid to the vertical and first and second lateral rams 64A, 64B, 96 and can also includes controls 105 for operating any rebar drive stations 36 connected thereto. The reservoir 93 is preferably be in fluid communication with rebar drive stations 36 connected to the carrier vehicle 30 via fluid conduits 95, 97, 99 which extend through a tube 32 that forms the main mount 32. The vehicle may include wheels 50 driven by motors 107 along tracks 48. While one preferred configuration for the vehicle 34 and one preferred method of moving the rebar drive stations 36 is disclosed, those of ordinary skill in the art will appreciate from this disclosure that any suitable mechanism or method for positioning at least one rebar drive station within the coil 38 can be used without departing from the scope of the present invention.

Figure 19:
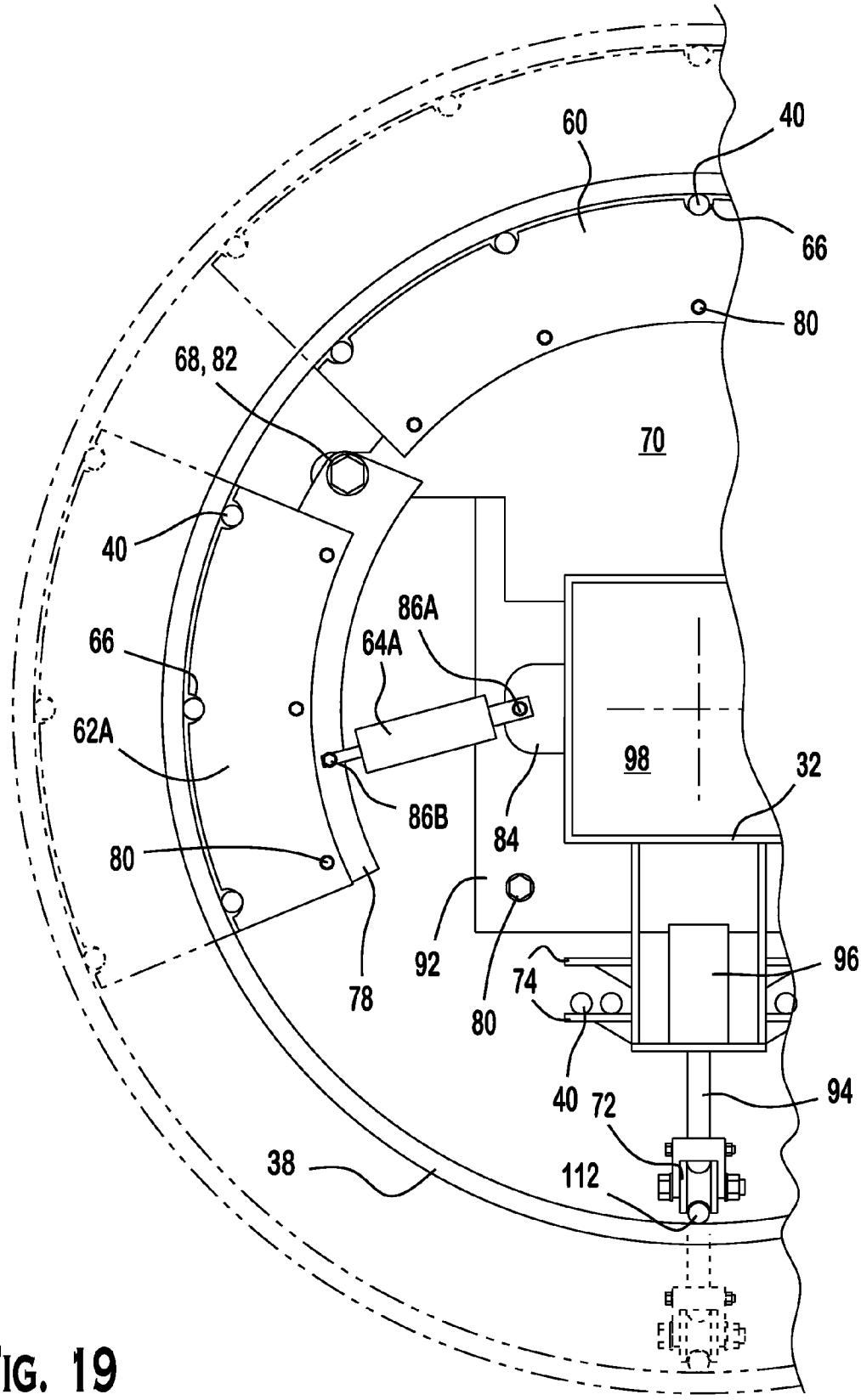
FIG. 19 illustrates how the rebar drive station of FIG. 11 can be used with coils having different diameters; Phantom lines illustrate the positioning of the first and second wing plates, the main plate, and the wheel when used with a larger diameter coil.

As shown in FIG. 19, the rebar drive station 36 can preferably be separately used with coils 38 having different inner diameters. This allows a single rebar installation system 30 to preferably be useable with projects involving coils having different diameters instead of needing a separately constructed rebar installation system every time a coil of a new diameter is to be worked on. By adjusting the displacement of the vertical and first and second hydraulic rams 96, 64A, 64B, the rams can preferably cooperate with the curved outer surface of the main and first and second wing plates 60, 62A, 62B to position the supported rebar 40 at locations corresponding to different coil inner diameters, thus increasing the range of coils 38 with which the rebar drive station 36 can be used.

It is preferred, but not necessary, that a controller 103 allows the first and second lateral rams 64A, 64B to be simultaneously operated. Referring to FIG. 5, it is preferred that at least one stability rod 110 is disposed on the main mount 32 or another portion of the tube section such that the rod 110 is configured to abut the inner surface of the coil to assist in the stabilization of the rebar drive station 36 and supporting tube, rod, or main mount 32 during insertion into the coil. It is preferably that at least two stability rods 110 are located proximate an end of the rebar installation system distal from the vehicle to help control torque that is experienced by the central tube during insertion into the coil 38. It is further preferably, but not necessary that two stability rods are provided for each direction of torque and that the rods may be adjustable and/or removable. Additional stability rods may also be located at intermediate locations along the length of the whole tube that is inserted in to the coil during the reinforcement process.

Figure 20:
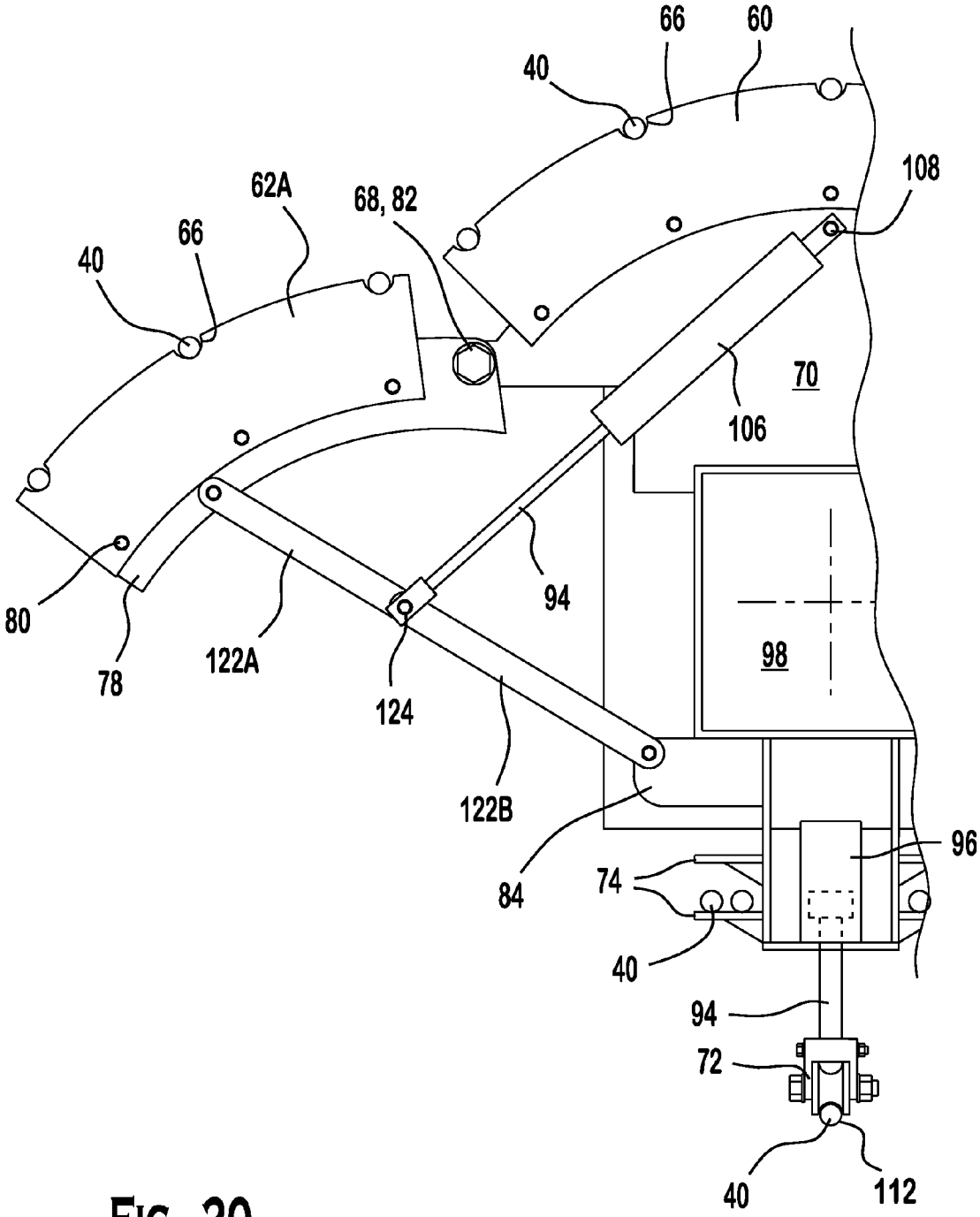
FIG. 20 illustrates a second preferred embodiment of a rebar drive station that uses a two bar linkage with each of the first and second wing plates to increase the distance along which the plates can be extended; the rebar drive station is shown with the first wing plate extended.
Figure 21:
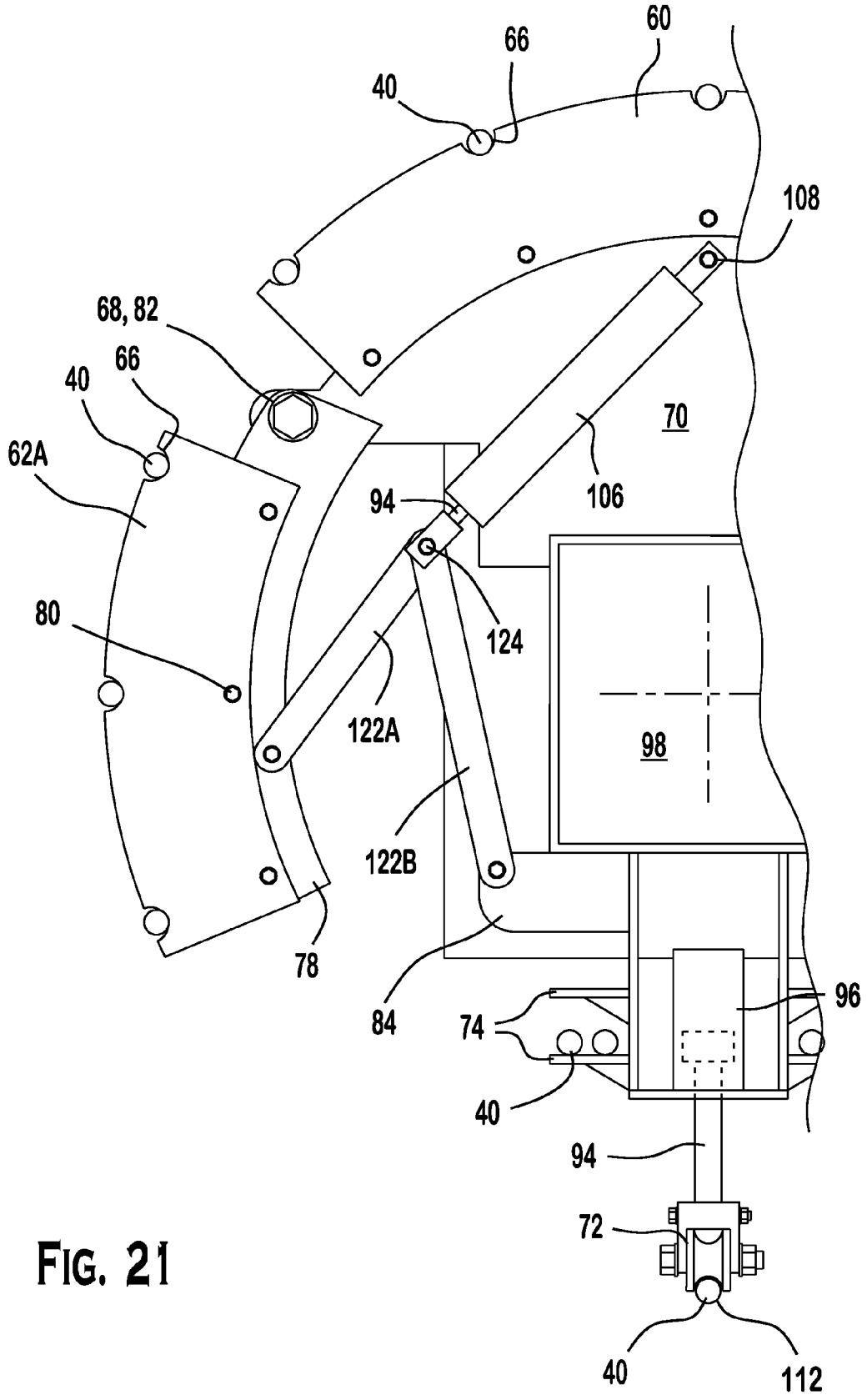
FIG. 21 illustrates the rebar drive station of FIG. 20 with the first wing plate retracted.

Referring to FIGS. 20 and 21, an alternative embodiment of the rebar installation system 30 may include a two bar linkage positioned between each of the first and second wing plates 62A, 62B and the main support 32. The two bar linkage is formed by first and second links 122A, 122B joined at a linkage pivot 124. Each of the first and second lateral rams 64A, 64B preferably extend between the linkage pivot 124 associated with one of the first and second wing plates 62A, 62B and the main mount 60. The main mount 32 of either embodiment may include lateral plates 84.

A preferred embodiment of attaching rebar to an inner surface of a coil according to the present invention is described below. Those of ordinary skill in the art will appreciate from this disclosure that generally similar steps and generally similar structural components of the rebar installation system 30 described below may: generally have similar structure, generally include similar alternate constructions, and generally operate in a similar manner as that described above, unless stated otherwise. The steps of the method of the present invention can be performed in any order, interchanged with other steps, or omitted, without departing from the scope of the present invention.

One preferred method of the present invention for attaching rebar 40 to an inner surface of a coil 38 includes the step of positioning rebar 40 on at least two drive stations 36. At least two rebar drive stations 36 are moved into a coil by moving the at least two drive stations 36 generally along a longitudinal axis 116 thereof (i.e., along a longitudinal axis 116 of the coil 38). A main plate 60 of each rebar drive station 36 is moved toward the inner surface of the coil 38 to secure rebar 40 against an inner surface of the coil 38.

It is preferred that the step of moving the rebar drive stations 36 into the coil 38 includes placing a guide rebar 112 along a lowest central point 114 of the coil 38. The rebar drive stations 36 may each include a wheel 72 that is positioned on the guide rebar 112 to facilitate moving the rebar drive stations 36 into the coil 38.

First and second wing plates 32A, 32B of each rebar drive station 36 are preferably moved about separate pivot points 68 to secure rebar 40 against an inner surface of the coil 38. The main and first and second wing plates 60, 62A, 62B of each rebar drive station 36 may move through a common plane 63. The outer surface of the main and first and second wing plates 60, 62A, 62B of each rebar drive station 32 may be arcuate and may be configured such that when the main and first and second wing plates 60, 62A, 62B are pressing rebar against the inner surface of the coil 38 there is rebar 40 spaced along the coil generally along a segment of the inner circumference of the coil 38. Rebar 40 that is detachably supported on the rebar drive stations 36 may be manually moved and positioned along lower portions of the inner surface of the coil 38.

Figure 22:
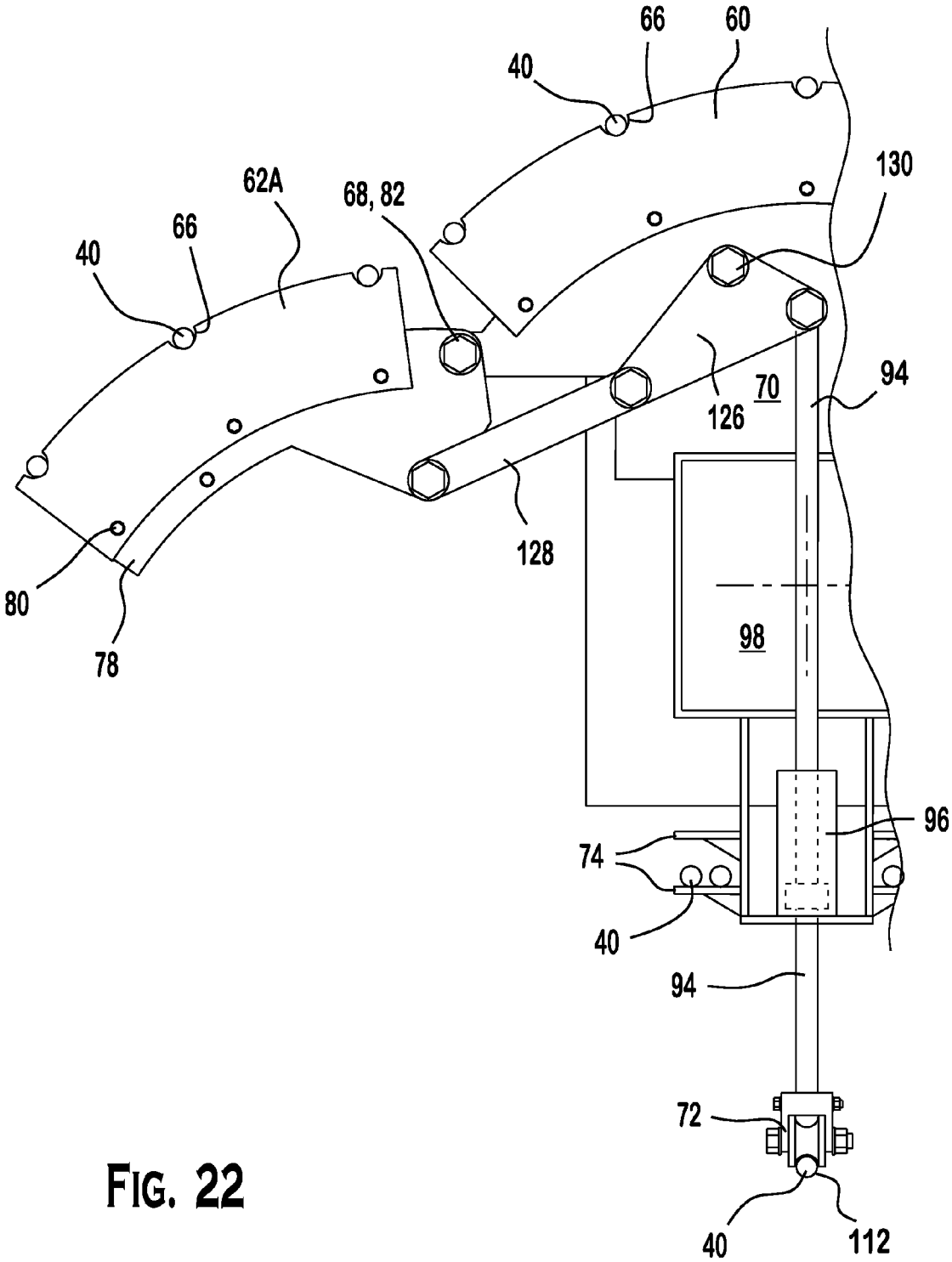
FIG. 22 is a partial broken away view of a third preferred embodiment of a rebar drive station that uses a single vertical ram to operate the main and first and second wing plates; the vertical ram may be a double sided piston that projects above and below the central tube; a bell crank may be connected to a support plate about a bell crank center of rotation with one end of the bell crank connected to a top end of the vertical ram piston and another end of the bell crank being connected to a wing plate; Another bell crank may also be secured to the top of the vertical ram piston to allow both first and second wing plates to be simultaneously operated be a single ram; This may allow the rebar drive station to operate using a single ram.
Figure 23:
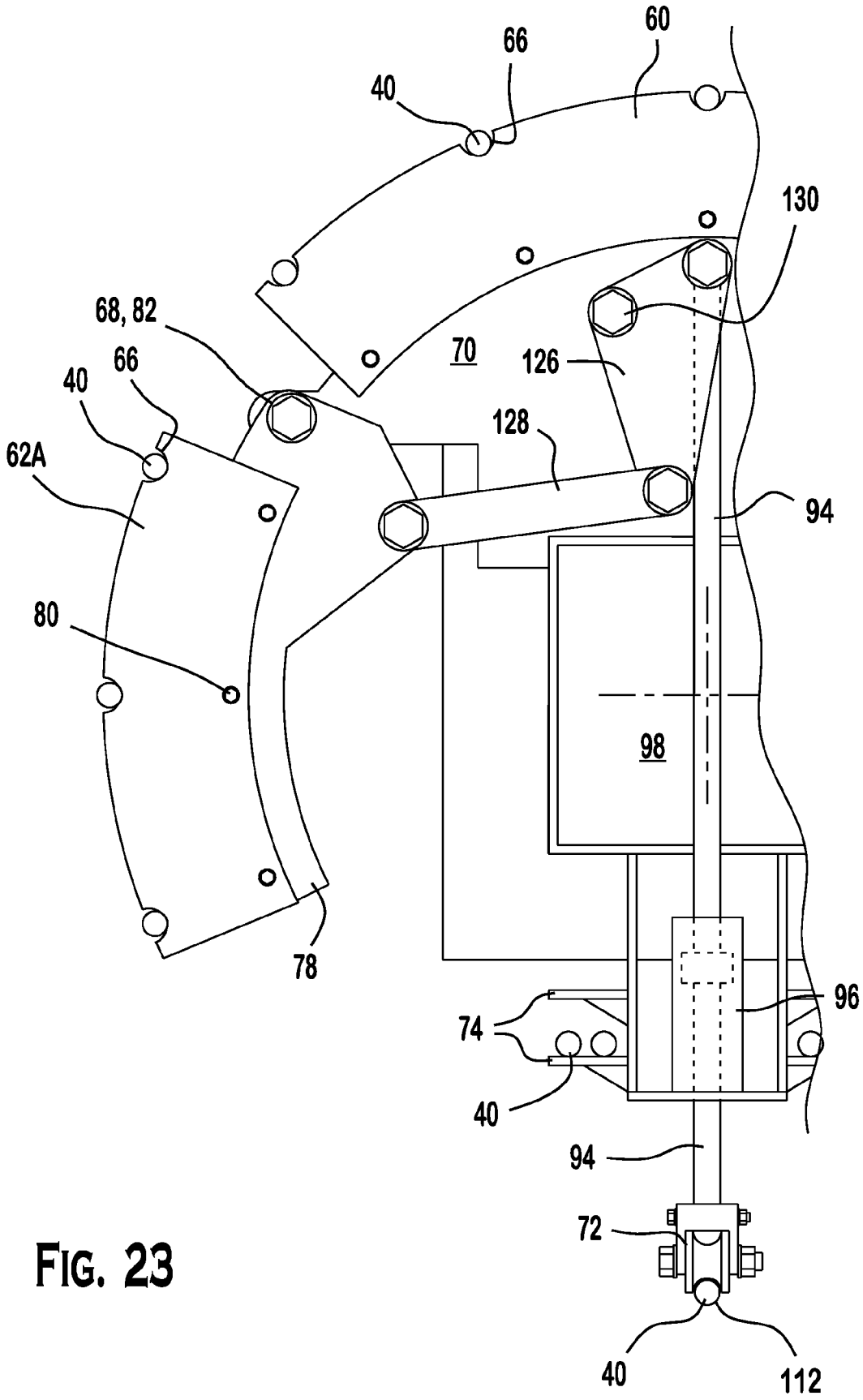
FIG. 23 is a partial broken away view similar to FIG. 22 showing the single vertical ram positioned to retract the main and first and second wing plates.

Referring to FIGS. 22 and 23 a third preferred embodiment of a rebar drive station may include a single vertical ram 96 to operate the main and first and second wing plates 60, 62A, 62B. The vertical ram 96 may be a double sided piston that includes a piston 94 which projects above and below the central tube 32. A bell crank 126 may be connected to a support plate 70 about a bell crank center of rotation 130 with one end of the bell crank connected to a top end of the vertical ram piston 94 and another end of the bell crank 126 being connected to a wing plate 62A via a drive rod/connector 128. Another bell crank (not shown) may also be secured to the top of the vertical ram piston 94 to allow both first and second wing plates 62A, 62B to be simultaneously operated be a single ram 96. This may allow the rebar drive station 36 to operate using a single ram 96. Referring specifically to FIG. 22 the rebar drive station 36 is shown with the single vertical ram piston 94 positioned so as to fully extend the main and first and second wing plates 60, 62A, 62B. Referring specifically to FIG. 23 the single vertical ram piston 94 is positioned to retract the main and first and second wing plates 60, 62A, 62B.

Figure 24:
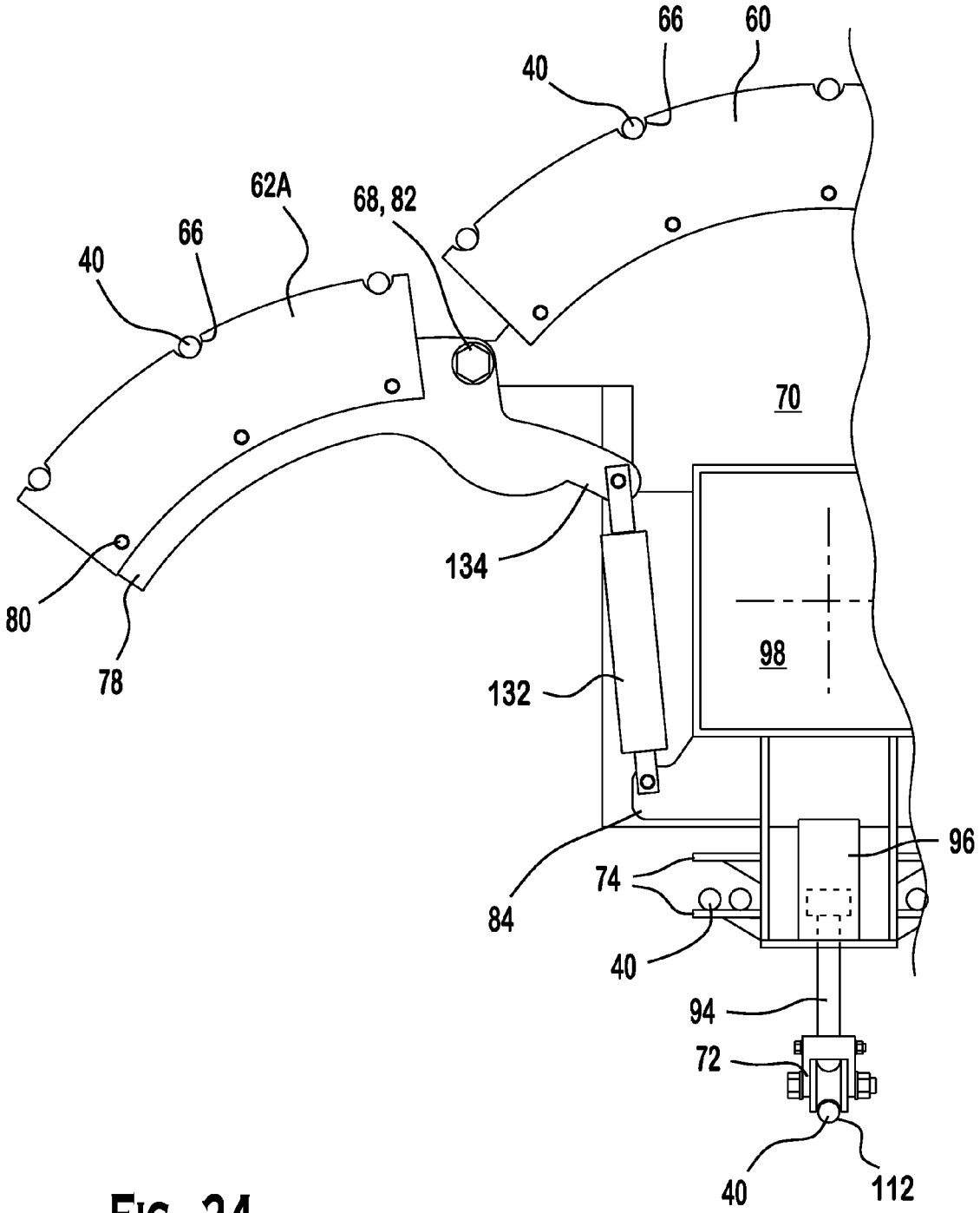
FIG. 24 is a partial broken away view of a fourth preferred embodiment of the rebar drive station of the present invention; The lateral support plate 78 may include a lever that extends outwardly from the pin in generally another direction from the lateral support plate to engage a lateral ram; The rebar drive station is shown with the main and first and second wing plates extended.
Figure 25:
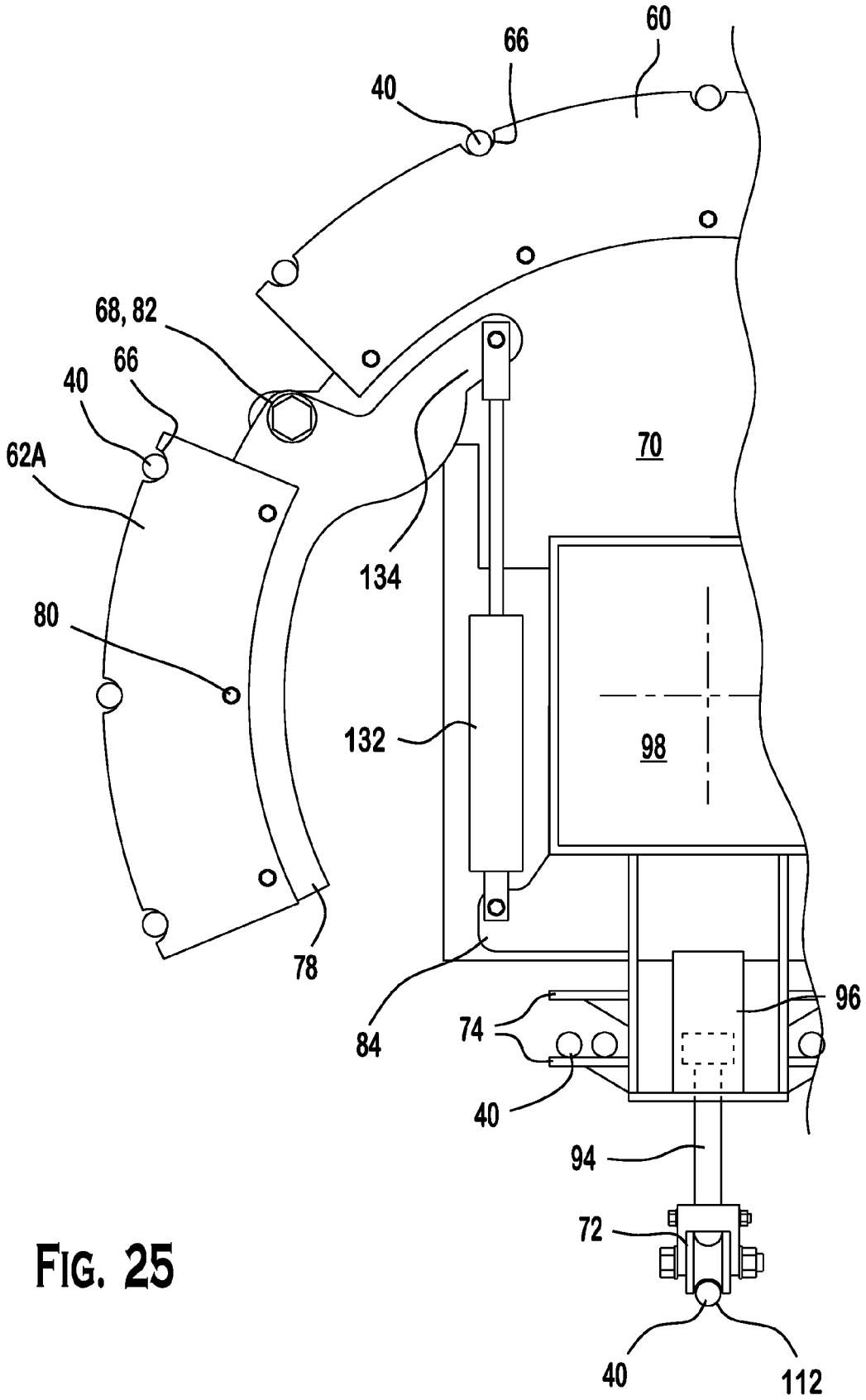
FIG. 25 is a partial broken away view of the rebar drive station of FIG. 24 showing the lateral ram 132 extended to retract the associated lateral wing plate.

Referring to FIGS. 24 and 25, a fourth preferred embodiment of the rebar drive station 36 of the present invention. The lateral support plate 78 may include a lever 134 that extends outwardly from the pin 82 in generally another direction from that of the lateral support plate 78 to engage a lateral ram 132. Referring specifically to FIG. 24, the rebar drive station 36 is shown with the main and first and second wing plates 60, 62A, 62B extended. Referring specifically to FIG. 25, the lateral ram 132 extended to retract the associated lateral wing plate 62A.

Figure 26:
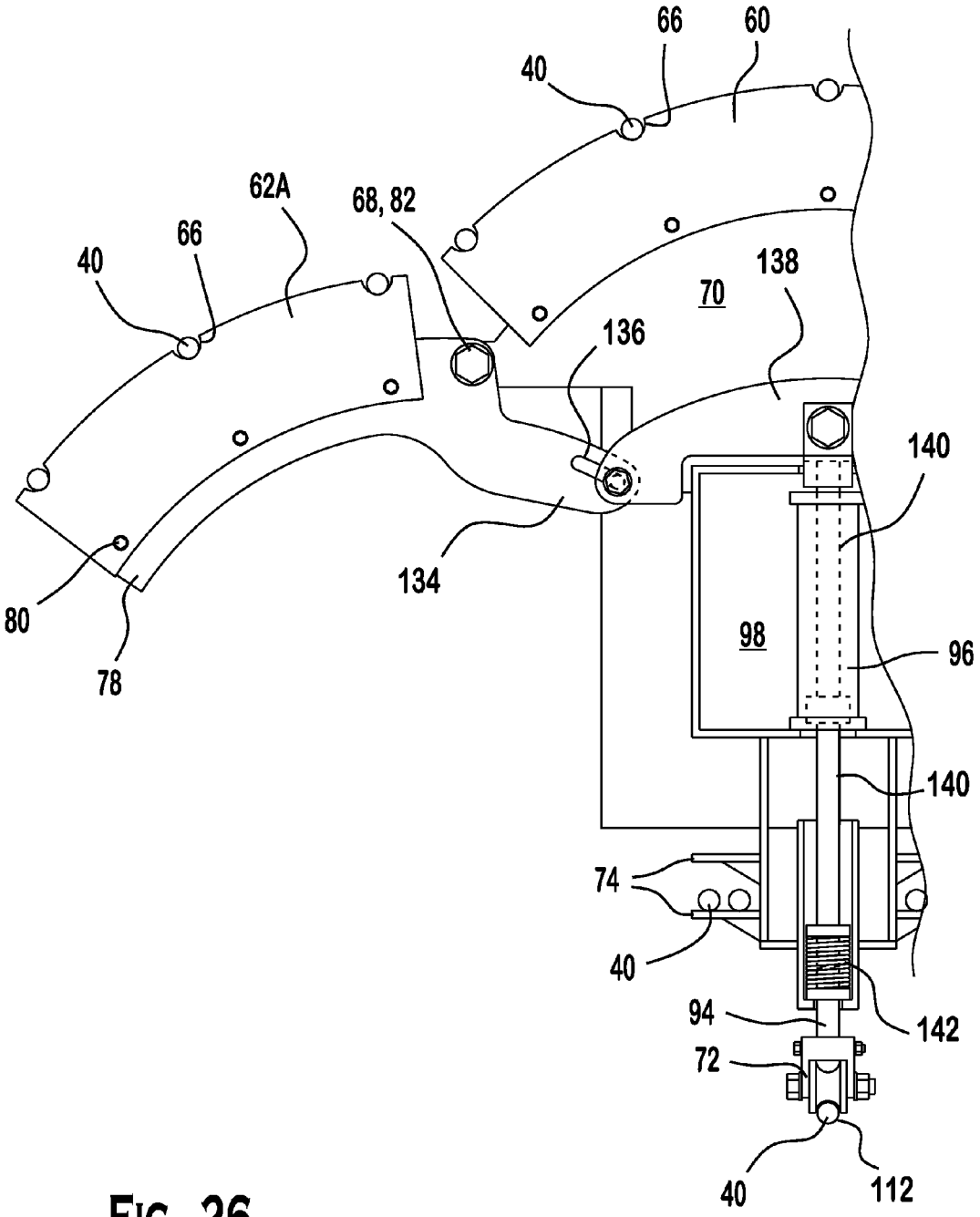
FIG. 26 is a partial broken away view of a fifth preferred embodiment of the rebar drive station of the present invention; The wheel may be slidably positioned within a sleeve; A spring can be connected between the wheel and the lower end of the double sided piston; The top end of the piston can be secured to a drive yolk; The drive yolk can be connected to a lever of the lateral wing plate via a cam slot.
Figure 27:
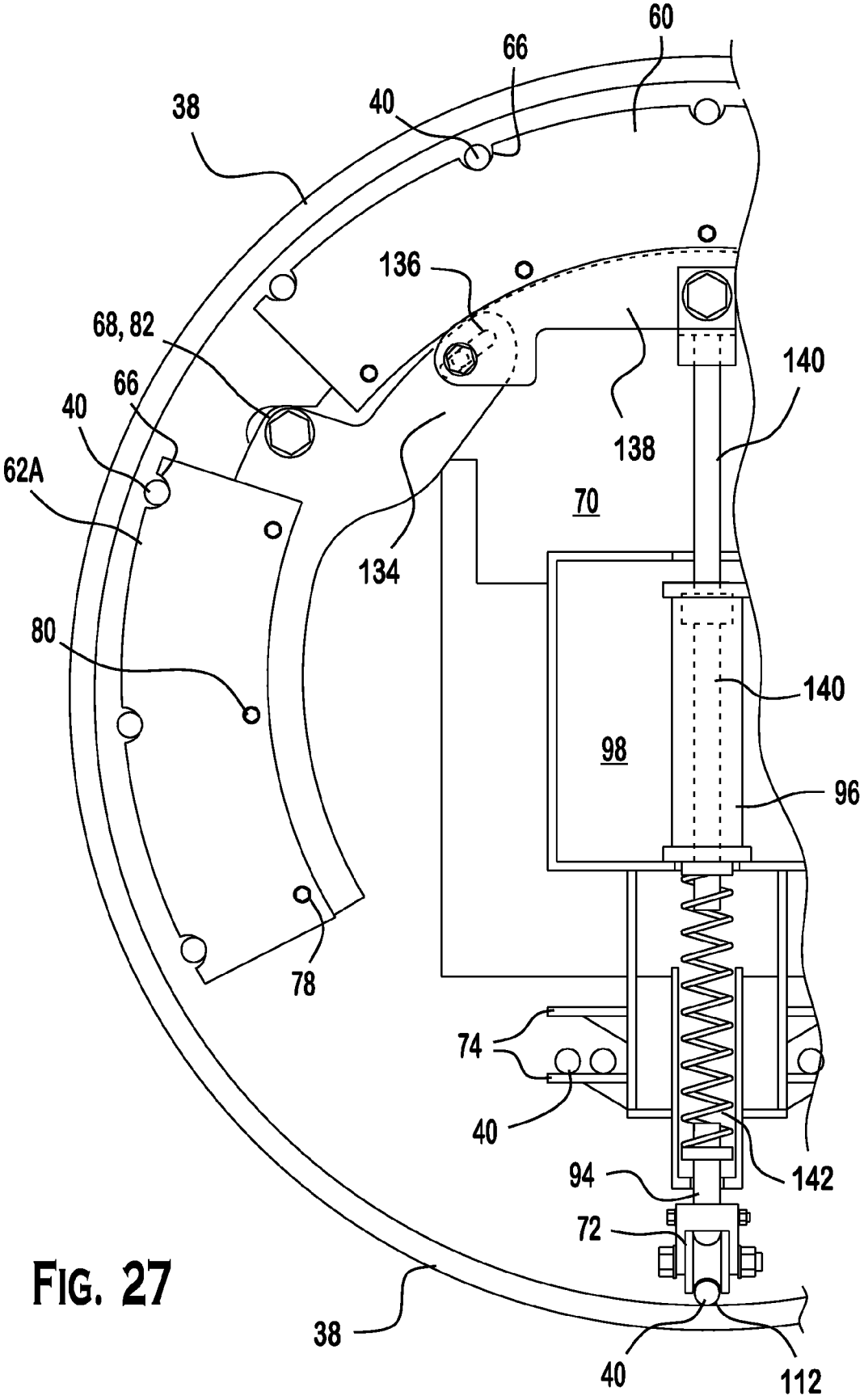
FIG. 27 is a partial broken away view of the rebar drive station of FIG. 26 located within a coil; The vertical ram can piston may be fully extended to cause the lateral wing plates and wheel to retract to allow the rebar drive station to be inserted into the coil.
Figure 28:
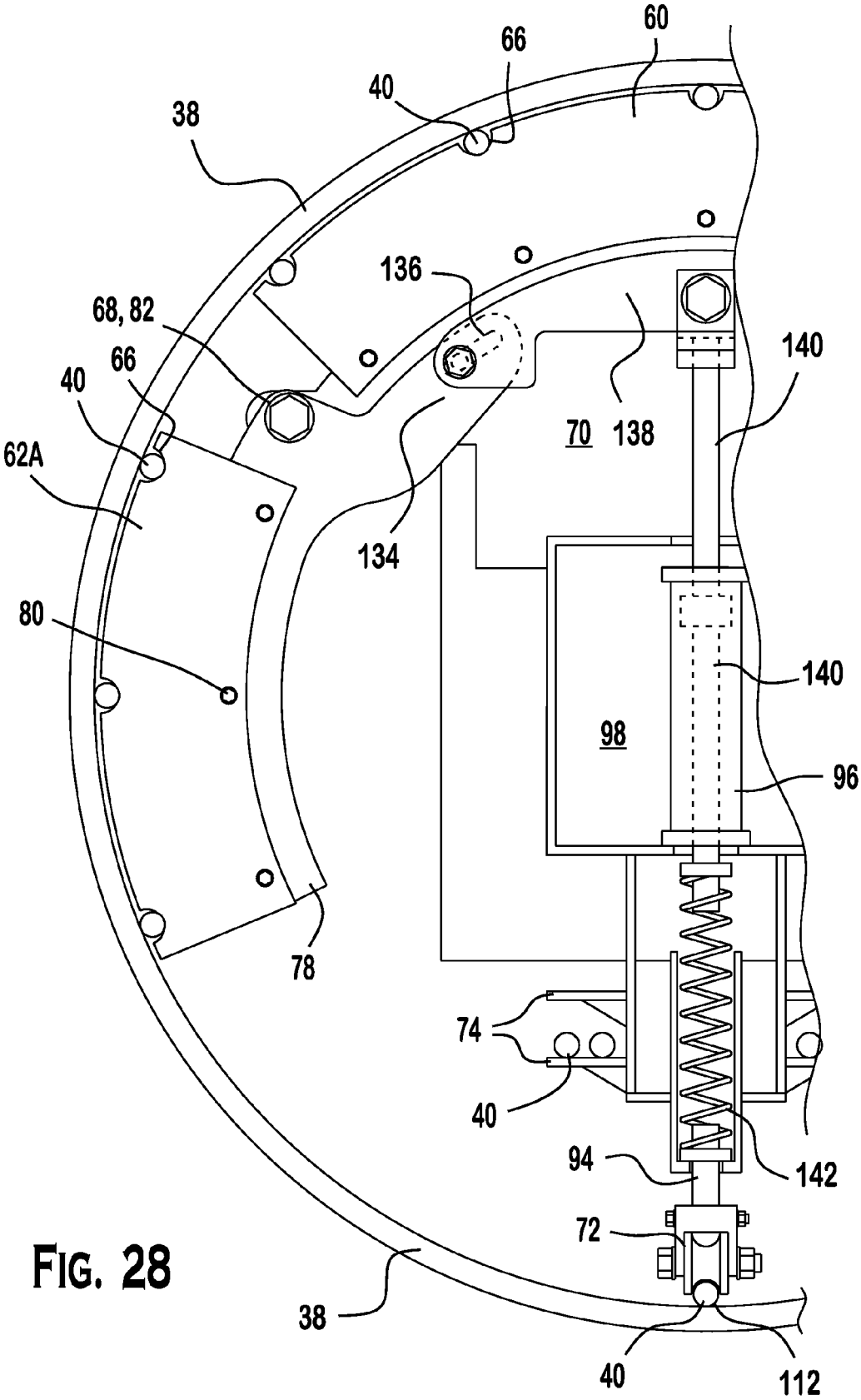
FIG. 28 is a partial broken away view of the rebar drive station of FIG. 26 which illustrates the vertical ram piston partially retracted to slightly extend the first and second lateral wing plates and to cause the bottom wheel to extend and drive the main plate against the inside of the coil.

FIGS. 26-28 illustrate a fifth preferred embodiment of the rebar drive station 36 of the present invention. The wheel 72 may be slidably positioned within a sleeve 96. A spring 142 can be connected between the wheel 72 and the lower end of the double sided ram piston 140. The top end of the piston 140 can be secured to a drive yolk 138. The drive yolk 138 can be connected to a lever 134 of the lateral wing plate 62A via a cam slot 136. Referring specifically to FIG. 26 the rebar drive station 36 is shown with the ram piston 140 fully withdrawn to cause the lateral wing plates 62A to be fully extended and the wheel 72 to be fully extended. Referring specifically to FIG. 27, the rebar drive station 36 is shown placed within a coil 38 with the vertical ram piston 140 fully extended to cause the lateral wing plates 62A, 62B and wheel 72 to retract to allow the rebar drive station 36 to be inserted into the coil 38. Referring specifically to FIG. 28, the rebar drive station 36 has the vertical ram piston 140 partially retracted to slightly extend the first and second lateral wing plates 62A, 62B and to cause the bottom wheel 74 to extend and drive the main plate 60 against the inside of the coil 38.

Referring to FIGS. 1-19, one preferred embodiment of the invention operates as follows. A coil 38 is positioned on a jig 54. The appropriate number of tube sections 104, 106 are secured in an end-to-end fashion to a mount section 102 attached to a carrier vehicle 34. The tube sections 102, 104, and 106 are secured together via mounting plates 92 and fluid and control lines 95, 97, 99 extending through each tube section 102, 104, 106 are connected via quick connects 91. Alternatively, the first drive station 36 may be connected on a tube attached to the vehicle without mount section 102 and the associated mounting plate 92 located therebetween without departing from the scope of the present invention.

Rebar 40 is positioned on main and first and second wing plates 60, 62A, 62B of the drive stations 36 which are generally in an at least partially retracted position 90. Steel ties can be inserted through holes 77 (shown in FIG. 11) and then wrapped about a portion of rebar to secure the rebar 40 in a proximate cutout 66. Although steel ties and holes 77 can be used to secure rebar on the main and first and second wing plates 60, 62A, 62B, those of ordinary skill in the art will appreciate from this disclosure that any other suitable method can be used without departing from the scope of the present invention. Rebar 40 is also positioned on the flanges 74 of the drive stations for later manual removal. While the flanges 74 are shown having a certain number, width, and length, those of ordinary skill in the art will appreciate from this disclosure that their dimensions and number can be varied as desired without departing from the scope of the present invention. The flanges 74 may also be L-shaped so that the short leg extends below the flange to add additional support. The height of the flanges 74 relative to the tube section 32 can be varied without departing from the scope of the present invention.

A piece of generally straight guide rebar 112 is then positioned at the lowest central point 114 on the inner surface of the coil. Wheels 72 for each of the rebar drive stations 36 are positioned on the guide rebar 112 such that the wheels 72 provide vertical support for the rebar drive stations 36 and associated tube sections 102, 104, 106 during insertion into the coil. Stability rods 110 preferably contact an inner surface of the coil 38 to reduce twisting torque on the tube sections 102, 104, 106 during insertion. Alternatively, the single vertical ram could be replaced with a framed two wheel insertion modules without departing from the scope of the present invention.

Then, the vehicle 34 moves the rebar drive stations 36 into the coil 38. After the rebar drive stations 36 are properly positioned, the vertical ram 96 is activated to extend the main plate 60 toward the upper inner surface of the coil 38 and secure rebar 40 thereagainst. Then, the first and second lateral rams 62A, 62B are activated to extend the first and second lateral rams 62A, 62B toward the coil 38 to secure rebar 40 thereagainst. The tying of the rebar in position can be done using steel ties to secure the rebar in position before the rebar system 30 is removed from the coil. It is preferred that the rebar 40 is tied to the coil 38 every ten to twelve feet or any preferred interval and is called a template. Then, the steel ties that may secure the rebar to the rebar drive station 36 via the holes 77 are removed and the rebar dive station 36 removed from the coil 38. Once the rebar drive station 36 is removed from the coil 38, the rebar 40 is tied to additional intersections between the rebar and the coil. The rebar 40 may be tied to the coil at every other intersection or more of the coil. In some cases, the rebar 40 may be tied to fewer intersections depending on the project. Afterwards, the rebar 40 supported on the flanges is manually positioned along the inner surface of the coil. The rebar 40 is then preferably tied to the coil to form the completed reinforcement cage. A crane may then be used to insert the structure in a hole or to load it onto a transport vehicle. If the completed reinforcement cage is to be stockpiled or transported a standard rack system may be used without departing from the scope of the present invention.

It is recognized by those skilled in the art, that changes may be made to the above described embodiment of the invention without departing from the broad inventive concept thereof. It is understood, therefore, that this invention is not limited to the particular embodiment disclosed, but is intended to cover to all modifications which are within the spirit and scope of the invention as defined by the appended claims and the drawings.

I claim:

1. A rebar installation system adapted for locating rebar along an inner surface of a coil, comprising:

a rebar drive station, comprising:

a main mount;

a main plate supported by the main mount and adapted to support rebar thereon, the main plate generally defining a plane;

first and second wing plates each connected to the rebar drive station and each configured to pivot about a separate point proximate to the main plate for rotational motion generally through the plane, the first and second wing plates each adapted to support rebar thereon;

first and second lateral rams each extending between the main mount and one of the first and second wing plates, the first and second lateral rams being configured to drive the first and second wing plates generally outwardly from the main mount;

a vertical ram generally located proximate an opposite side of the main mount from the main plate for operation generally within the plane;

a wheel located on an end of the vertical ram distal from the main support and adapted to support the main mount on rebar, wherein the rebar drive station is configured to move into the coil with assistance from the wheel, once the rebar drive station is located within the coil the vertical ram is adapted to extend to cause the rebar supported by the main plate to press against the inner surface of the coil and the first and second lateral rams are adapted to extend to cause the first and second wing plates to rotate generally outwardly so that the rebar supported thereon is pressed against the inner surface of the coil.

2. The system of claim 1, wherein the main mount is a tube section having at least one end with a connection plate thereon adapted to engage another tube section.

3. The system of claim 2, wherein the other tube section has at least one rebar drive station.

4. The system of claim 3, wherein the first and second lateral rams and the vertical ram are formed by hydraulic pistons, control lines for the hydraulic pistons extend at least partially through the tube section.

5. The system of claim 3, further comprising a carrier vehicle that supports another connection plate adapted to secure at least one main mount thereto, the at least one main mount including the rebar drive station.

6. The system of claim 5, wherein the carrier vehicle further comprises a reservoir for supplying fluid to the vertical and first and second lateral rams and also includes controls for operating any rebar drive stations connected thereto, the reservoir being in communication with any rebar drive stations connected to the carrier vehicle via fluid conduits which extend through a tube that forms the main mount.

7. The system of claim 1, further comprising flanges extending generally laterally outwardly from the rebar drive station and adapted to support rebar thereon to facilitate transport and manual removal thereof.

8. The system of claim 1, wherein the main mount comprises a tube and a housing located thereon and adapted to secure the vertical ram to the rebar drive station, flanges extending generally laterally outwardly from the vertical ram and adapted to support rebar thereon to facilitate transport and manual removal thereof.

9. The system of claim 1, wherein the rebar drive station can be separately used with coils having different inner diameters, the vertical and first and second hydraulic rams cooperating with the curved outer surface of the main and first and second wing plates to position the supported rebar at locations corresponding to different coil inner diameters, thus increasing the range of coils with which the rebar drive station can be used.

10. The system of claim 1, wherein the main mount includes a support plate thereon on which the main plate is positioned, each of the first and second wing plates including a lateral support plate, between each of the first and second wing plates and the main support is positioned a two bar linkage formed by first and second links joined at a linkage pivot, each of the first and second lateral rams extending between the linkage pivot associated with one of the first and second wing plates and the main mount.

11. The system of claim 1, wherein a controller allows the first and second lateral rams to be simultaneously operated.

12. The system of claim 1, wherein the outer surface of the main and first and second wing plates is arcuate and are configured such that when the main and first and second wing plates are pressing rebar against the inner surface of the coil there is rebar spaced along the coil generally along the upper half of the coil.

13. The system of claim 1, wherein the outer surface of the main and first and second wing plates is arcuate and are configured such that when the main and first and second wing plates are pressing rebar against the inner surface of the coil there is rebar spaced along the coil generally along approximately fifty percent of the inner circumference of the coil.

14. The system of claim 1, wherein the outer surface of the main and first and second wing plates is arcuate and are configured such that when the main and first and second wing plates are pressing rebar against the inner surface of the coil there is rebar spaced along the coil generally along approximately fifty five percent of the inner circumference of the coil.

15. The system of claim 1, wherein the outer surface of the main and first and second wing plates is arcuate and are configured such that when the main and first and second wing plates are pressing rebar against the inner surface of the coil there is rebar spaced along the coil generally along approximately sixty percent of the inner circumference of the coil.

16. A rebar installation system adapted for locating rebar along an inner surface of a coil, comprising:

a rebar drive station, comprising:

a main mount;

a main plate supported by the main mount and adapted to support rebar thereon;

first and second wing plates each connected to the rebar drive station and configured to each pivot about a separate point proximate to the main plate for rotational motion;

first and second lateral rams each extending between the main mount and one of the first and second wing plates, the first and second lateral rams being configured to drive the first and second wing plates generally outwardly from the main mount;

a vertical ram generally located proximate an opposite side of the main mount from the main plate for operation generally within the plane;

a wheel located on an end of the vertical ram distal from the main support and adapted to support the main mount on rebar, wherein the rebar drive station is configured to move into the coil along a central longitudinal axis thereof with assistance from the wheel, once the rebar drive station is located within the coil the vertical ram is adapted to extend to cause the rebar supported by the main plate to press against the inner surface of the coil and the first and second lateral rams are adapted to extend to cause the first and second wing plates to rotate generally outwardly so that the rebar supported thereon is pressed against the inner surface of the coil.

17. The system of claim 16, further comprising:

the main mount comprising a tube section having at least one end with a connection plate thereon adapted to engage another tube section, the other tube section has at least one rebar drive station;

the first and second lateral rams and the vertical ram are formed by hydraulic pistons, control lines for the hydraulic pistons extend at least partially through the tube section; and a carrier vehicle that supports another connection plate adapted to secure at least one main mount thereto, the at least one main mount including the rebar drive station, the carrier vehicle further comprises a reservoir for supplying fluid to the vertical and first and second lateral rams and also includes controls for operating any rebar drive stations connected thereto, the reservoir being in communication with any rebar drive stations connected to the carrier vehicle via fluid conduits which extend through a tube that forms the main mount;

wherein the outer surface of the main and first and second wing plates is arcuate and are configured such that when the main and first and second wing plates are pressing rebar against the inner surface of the coil there is rebar spaced along the coil generally along approximately forty percent of the inner circumference of the coil.

* * * * *